US009351347B2

(12) United States Patent
Torres et al.

(10) Patent No.: US 9,351,347 B2
(45) Date of Patent: May 24, 2016

(54) DEVICE AND METHOD FOR APPLYING ELECTROMAGNETIC ENERGY TO A CONTAINER

(75) Inventors: Eyal Torres, Savyon (IL); Daniel Selinger, Tel-Aviv (IL); Daniella Atzmony, Shoham (IL); Pinchas Einziger, Haifa (IL); Amit Rappel, Ofra (IL); Eliezer Gelbart, Holon (IL); Igal Yaari, Palo Alto, CA (US); Avner Libman, Holon (IL)

(73) Assignee: GOJI LIMITED, Hamilton (BM)

( * ) Notice: Subject to any disclaimer, the term of this patent is extended or adjusted under 35 U.S.C. 154(b) by 405 days.

(21) Appl. No.: 13/878,510

(22) PCT Filed: Oct. 11, 2011

(86) PCT No.: PCT/US2011/055797

§ 371 (c)(1),
(2), (4) Date: Jun. 11, 2013

(87) PCT Pub. No.: WO2012/051198

PCT Pub. Date: Apr. 19, 2012

(65) Prior Publication Data

US 2013/0248521 A1 Sep. 26, 2013

Related U.S. Application Data

(60) Provisional application No. 61/392,178, filed on Oct. 12, 2010.

(51) Int. Cl.
*H05B 6/80* (2006.01)
*H05B 6/64* (2006.01)
(Continued)

(52) U.S. Cl.
CPC ..... *H05B 6/6408* (2013.01); *H05B 6/6402* (2013.01); *H05B 6/70* (2013.01); *H05B 6/72* (2013.01); *H05B 6/76* (2013.01); *H05B 6/80* (2013.01)

(58) Field of Classification Search
CPC ..... H05B 6/70; H05B 6/72; H05B 6/6402; H05B 6/80; H05B 6/6408; H05B 6/76
USPC ..... 219/728–732, 734, 738, 710, 756, 757, 219/762; 422/21, 22, 109, 288; 426/107, 426/114, 234; 220/293
See application file for complete search history.

(56) References Cited

U.S. PATENT DOCUMENTS 3,753,651 A * 8/1973 Boucher ..... 422/21
4,329,557 A 5/1982 Staats
(Continued)

FOREIGN PATENT DOCUMENTS

CA 2718322 A1 10/2009
CA 2718322 A1 10/2009
(Continued)

OTHER PUBLICATIONS

International Preliminary Report on Patentability & Written Opinion mailed on Apr. 16, 2013 from the International Bureau of WIPO in counterpart International Application No. PCT/US2011/055797 (9 pages).
(Continued)

*Primary Examiner* — Quang Van
(74) *Attorney, Agent, or Firm* — Greenblum & Bernstein, P.L.C.

(57) ABSTRACT

Radiofrequency energy is applied to a container having an outer housing and an inner housing disposed at least partially within the outer housing. At least a portion of the inner housing is transparent to RF radiation. At least one antenna is configured to apply RF energy to an energy application zone within the inner housing. A processor is configured to control the application of RF energy to the energy application zone by selecting a set of modulation space elements (MSEs), and cause RF energy application at the modulation space elements of the selected set.

21 Claims, 18 Drawing Sheets

(51) Int. Cl.

| | |
|---|---|
| ***B65D 81/34*** | (2006.01) |
| ***H05B 6/70*** | (2006.01) |
| ***H05B 6/72*** | (2006.01) |
| ***H05B 6/76*** | (2006.01) |

(56) References Cited

U.S. PATENT DOCUMENTS

| | | | | |
|---|---|---|---|---|
| 4,663,506 | A * | 5/1987 | Bowen et al. | 219/730 |
| 4,835,354 | A * | 5/1989 | Collins et al. | 219/757 |
| 4,934,829 | A | 6/1990 | Wendt | |
| 4,992,638 | A | 2/1991 | Hewitt et al. | |
| 5,322,984 | A | 6/1994 | Habeger et al. | |
| 6,501,057 | B1 | 12/2002 | Jarvis | |
| 9,040,879 | B2 | 5/2015 | Libman et al. | |
| 2005/0067412 | A1 | 3/2005 | Kim | |
| 2006/0006172 | A1 | 1/2006 | Sedlmayr | |
| 2006/0289502 | A1 | 12/2006 | Sedlmayr | |
| 2008/0266012 | A1 * | 10/2008 | Yahata et al. | 331/177 R |
| 2009/0074631 | A1 | 3/2009 | Longo | |
| 2009/0236335 | A1 | 9/2009 | Ben-Shmuel et al. | |
| 2011/0031236 | A1 | 2/2011 | Ben-Shmuel et al. | |
| 2011/0104793 | A1 | 5/2011 | Grange et al. | |
| 2011/0142732 | A1 | 6/2011 | Liskin | |
| 2013/0056460 | A1 | 3/2013 | Ben-Shmuel et al. | |
| 2013/0200066 | A1 | 8/2013 | Gelbart et al. | |
| 2014/0287100 | A1 | 9/2014 | Libman | |
| 2015/0034632 | A1 | 2/2015 | Brill et al. | |
| 2015/0070029 | A1 | 3/2015 | Libman et al. | |

FOREIGN PATENT DOCUMENTS

| | | | |
|---|---|---|---|
| CN | 2530203 | Y | 1/2003 |
| CN | 2530203 | Y | 1/2003 |
| CN | 1464227 | A | 12/2003 |
| CN | 1528107 | A | 9/2004 |
| CN | 1603690 | A | 4/2005 |
| DE | 3743922 | A1 | 7/1989 |
| DE | 3743922 | A1 | 7/1989 |
| FR | 2677853 | | 12/1992 |
| GB | 1507069 | | 4/1978 |
| JP | 60-135307 | U | 9/1985 |
| JP | 2-82222 | U | 6/1990 |
| JP | 7-171050 | A | 7/1995 |
| JP | 2002-93788 | A | 3/2002 |
| JP | 2008-66292 | A | 3/2008 |
| JP | 2008-220469 | A | 9/2008 |
| WO | WO-00-36878 | A1 | 6/2000 |
| WO | 02/34013 | | 4/2002 |
| WO | WO-02-34013 | | 4/2002 |
| WO | 2006/067579 | A2 | 6/2006 |
| WO | WO-2006-067579 | A2 | 6/2006 |
| WO | WO 2006/086049 | A1 | 8/2006 |
| WO | 2008/115226 | A2 | 9/2008 |
| WO | WO-2008-115226 | A2 | 9/2008 |

OTHER PUBLICATIONS

International Search Report & Written Opinion mailed on Aug. 12, 2011, in counterpart International Application No. PCT/US2011/055797 (13 pages).

Office Action in corresponding Chinese Application No. 201180047662.9, with English language translation, dated Sep. 8, 2015.

Translation of Office Action in corresponding Chinese Application No. 201180047662.9 dated Jun. 27, 2014.

Translation of Office Action in corresponding Chinese Application No. 201180047662.9 dated Mar. 6, 2015.

Extended European Search Report in corresponding European application No. 11833263.4 dated Nov. 27, 2014.

Office Action in corresponding Japanese Application No. 2013-533945, with English language summary, dated Jul. 28, 2015.

Office Action in corresponding Chinese Application No. 201180047662.9 dated Jun. 27, 2014.

Office Action in corresponding Chinese Application No. 201180047662.9 dated Mar. 6, 2015.

Abstract of US2011/0104793 of May 5, 2011.

Extended European Search Report in corresponding European application No. 11833263.4, dated Nov. 27, 2014, 6 pages.

Office Action in corresponding Chinese Application No. 201180047662.9, dated Jun. 27, 2014, 11 pages.

Office Action in corresponding Chinese Application No. 201180047662.9, dated Mar. 6, 2015, 11 pages.

* cited by examiner

DEVICE AND METHOD FOR APPLYING ELECTROMAGNETIC ENERGY TO A CONTAINER

CROSS-REFERENCE TO RELATED APPLICATIONS

This application claims the benefit of U.S. Provisional Application No. 61/392,178, filed Oct. 12, 2010, the disclosure of which is incorporated herein in its entirety.

TECHNICAL FIELD

This Patent Application relates to a device and method for applying electromagnetic energy, and more particularly, but not exclusively, to a device and method for applying electromagnetic energy to process objects placed in a container. For example, the present invention relates to applying electromagnetic energy to cook and/or prepare food (e.g., steaks, eggs, soup or yogurt) and/or food processing.

BACKGROUND

Electromagnetic waves have been used in various applications to supply energy to objects. Radio frequency (RF) electromagnetic energy, for example, may be supplied using a magnetron, which is typically tuned to a single frequency for supplying electromagnetic energy only at that frequency. One example of a commonly used device employing electromagnetic energy is a microwave oven. Typical microwave ovens supply electromagnetic energy at the single frequency of 2.45 GHz. To increase the distribution of electromagnetic waves, the typical microwave oven includes a metallic fan, often placed behind a grill in the oven, to disturb standing wave patterns in the electromagnetic radiation and achieve more uniform energy distribution in the oven's cavity. Objects in containers (e.g., liquids, etc.) may also be heated by transferring electromagnetic energy to elements located on the container walls, thereby heating the walls and the contents of the container.

SUMMARY OF A FEW EXEMPLARY ASPECTS OF THE DISCLOSURE

Some aspects of the invention may be directed to an apparatus and method for applying RF energy to a container. A container may include any vessel or object configured to hold or contain an object to be heated or processed. Examples of containers may include pots, tanks, vats, kettles, reactors, receptacles, etc. Objects within such containers may be heated or processed using EM energy. The object may be in the liquid phase, gas phase, solid phase or any combination of phases thereof.

RF energy may be applied to the container via at least one radiating element. In some embodiments, the container may include an outer housing and an inner housing. The at least one radiating element may be associated with an outer housing of the container. Alternatively or additionally, the radiating element may be located inside an inner housing of the container. The container may be configured to hold standing liquids, e.g., liquids that remain substantially within a portion of the container, rather than flowing through the container. In some embodiments, the radiating element may be isolated from the object (e.g., a liquid based object) by a shield transparent or partially transparent to EM energy. In some exemplary embodiments, the shield may include the inner housing of the container and the radiating element(s) may be installed in the interface between the inner housing and the outer housing of the container. The outer housing of the container may have an RF conductive wall that allows at least some RF radiation to pass through or, alternatively, made be made of a material substantially opaque to RF radiation (e.g., a material that blocks all or nearly all transmission of RF radiation).

Some aspects of the present invention may include an apparatus and method for applying RF energy to an object. The apparatus may comprise an outer housing; optionally the outer housing may be substantially opaque to RF energy (e.g., made of RF impermeable material). The apparatus may further comprise an inner housing disposed at least partially within the outer housing, wherein at least a portion of the inner housing is configured to transmit RF energy. The apparatus may include at least one radiating element configured to apply RF energy to an energy application zone within the inner housing. In some embodiments, the at least one radiating element may be located external to the inner housing, optionally between the inner housing and the outer housing. In some embodiments, the at least one radiating element may be activated and RF energy may be transmitted, via the at least one activated radiating element, to the object located within the energy application zone.

Some aspects of the invention may be related to a container for processing an object by applying RF energy. The container may be capable of holding standing liquids. The container may include an outer housing, optionally the outer housing may be substantially opaque to RF energy and an inner housing disposed within the outer housing and adapted to contain the object. The inner housing may be spaced apart from the outer housing and may include at least a portion that is transparent to RF energy. The container may further include at least one radiating element located within a space between the outer housing and the inner housing and configured to apply electromagnetic energy to a volume within the inner housing.

In some embodiments, the container may be configured to cook a food object or a food item, e.g., the container may include a cooking utensil (e.g., a cooking container). The cooking container may include an outer housing and an inner housing, wherein the inner housing may be adapted to contain a miscible food object and at least one radiating element configured to apply electromagnetic energy to a volume within the inner housing. The food container may further include a stirrer configured to stir the miscible food object. In some embodiments, the stirrer may be disposed within or partially within the inner housing. The cooking container may further include a processor configured to control application of electromagnetic energy via the at least one radiating element and to control the operation of the stirrer.

In some embodiments, a method for manufacturing a container, capable of holding standing liquids, may be provided. The method may comprise disposing an inner housing, at least partially within an outer housing, wherein at least a portion of the inner housing is configured to transmit RF energy. The method may further include associating at least one radiating element with the outer housing such that RF energy emitted from the at least one radiating element can be transmitted via the inner housing to a volume within the inner housing.

DETAILED DESCRIPTION

Figure 1:
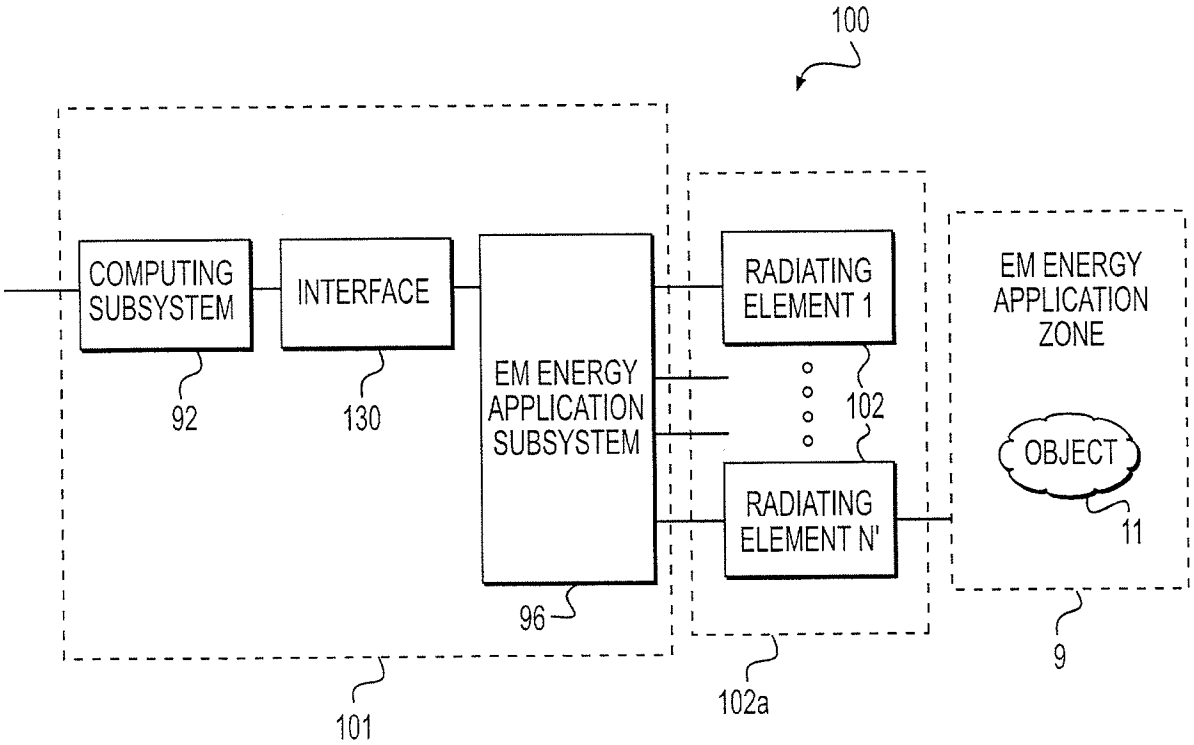
FIG. 1 is a diagrammatic representation an apparatus for applying electromagnetic energy to an energy application zone, in accordance with exemplary embodiments of the present invention.

Reference will now be made in detail to exemplary embodiments of the invention illustrated in the accompanying drawings. When appropriate, the same reference numbers are used throughout the drawings to refer to the same or like parts.

Some embodiments of the invention may be related to the application of EM energy, optionally at the RF range, for processing an object placed in a container. The term "object" as used herein may refer to a single object or a plurality of objects. The object(s) may be placed together in a container to be processed by RF energy simultaneously or serially. At least some of the objects placed together may be similar or different from each other. The object(s) may include any objects that can be processed using RF energy. Although several exemplary embodiments disclosed herein may refer to food items, the invention is not limited to any particular object. The objects may include food items (e.g., steaks, soups, stew, cakes, yogurt etc.) to be cooked, baked, warmed, steamed, dried or thawed; chemical solutions to be reacted; dense powder green bodies to be sintered, oil to be refined, etc. The object may include a liquid(s) phase, solid(s) phase, gas(es) phase or any combination of phases thereof. For example, the object may include soup comprising water and solid additives, such as herbs, vegetables, chicken etc. In yet another example, broccoli may be steamed in the container. Thus the object may include the broccoli and the water vapors in the container.

An aspect of some embodiments of the invention may include a container. A container may include any vessel or object configured to hold or contain an object to be heated or processed. A container may include any receptacle configured to hold item(s) or object(s), either in solid, liquid or gas phase. In some embodiments, the container may be capable of holding standing liquids. Examples of containers may include a tank, vat, reactor, etc. A container may include a cooking container or a cooking utensil, such as a pot, pan, kettle, mold, cooking oven, poyke, rice cooker, steamer, thawer, or the like. The container may include a cover or a top to seal the container during the RF energy application and/or the processing of the object (e.g., while cooking a food item). Sealing the container may reduce heat and/or vapors from leaking outside the container. In some embodiments, sealing may reduce or prevent EM radiation leakage. In some embodiments, a choke or a gasket may be provided to reduce or prevent EM radiation leakage from the container. Some exemplary containers are illustrated in FIGS. 2-6.

In some embodiments, electromagnetic energy (EM energy), optionally in the RF range, may be applied to the container to process an object placed in the container. The term "electromagnetic energy," as used herein, includes any or all portions of the electromagnetic spectrum, including but not limited to, radio frequency (RF), infrared (IR), near infrared, visible light, ultraviolet, etc. In one particular example, applied electromagnetic energy may include RF energy with a wavelength in free space of 100 km to 1 mm, which is a frequency of 3 kHz to 300 GHz, respectively. In some other examples, the frequency bands may be between 500 MHz to 1500 MHz or between 700 MHz to 1200 MHz or between 800 MHz to 1 GHz. Microwave and ultra high frequency (UHF) energy, for example, are both within the RF range. Applying energy in the RF portion of the electromagnetic spectrum is referred herein as applying RF energy. In some other examples, the applied electromagnetic energy may fall only within one or more ISM frequency bands, for example, between 433.05 and 434.79 MHz, between 902 and 928 MHz, between 2400 and 2500 MHz, and/or between 5725 and 5875 MHz. Even though examples of the invention are described herein in connection with the application of RF energy, these descriptions are provided to illustrate a few exemplary principles of the invention. They are not intended to limit the invention to any particular portion of the electromagnetic spectrum.

EM energy may be applied to a container, according to some embodiments of the invention, via at least one radiating element. A radiating element may include any element configured to transmit, emit or apply EM energy. In some embodiments, the radiating element may include an antenna, a waveguide, a slow-wave antenna etc. Several optional radiating elements in accordance with the invention are discussed broadly with respect to FIG. 1 and radiating element 102. The at least one radiating element may be located in various places within the container. For example, one or more radiating elements may be located in a peripheral area within the container, surrounding the object. Additionally or alternatively, the radiating element(s) may be located inside the container in proximity to the object. For example, if a stirrer is assembled in the container, for stirring liquid based object, the radiating element may be located near or on the stirrer. In some embodiments, the radiating elements may be isolated and/or shielded from the object. Some optional locations and configurations of radiating elements in a container are disclosed with respect to FIGS. 2-5.

In some embodiments, the container may comprise an outer housing optionally constructed to be substantially opaque to RF energy. The term substantially opaque or impermeable to RF used herein may be refer to all material configured to block or reflect RF energy such that little or no leakage of RF energy through the material may occur. For example, in some embodiments, substantially opaque or impermeable materials allow transmission of less than about 1% of incident RF radiation. In other embodiments, no more than 0.5% or even 0.1% of incident RF radiation may be transmitted through the substantially opaque or impermeable material.

The outer housing may be constructed from a conductive material, including, for example, metals and/or alloys, austenitic stainless steels, Al—Si alloys, cast iron, or the like. Optionally, the container may be constructed from other materials, including, for example, polymers or glass. The outer housing of the container may also be coated with RF reflecting material (such as a conductive material), to become substantially opaque to RF energy.

Figure 2B:
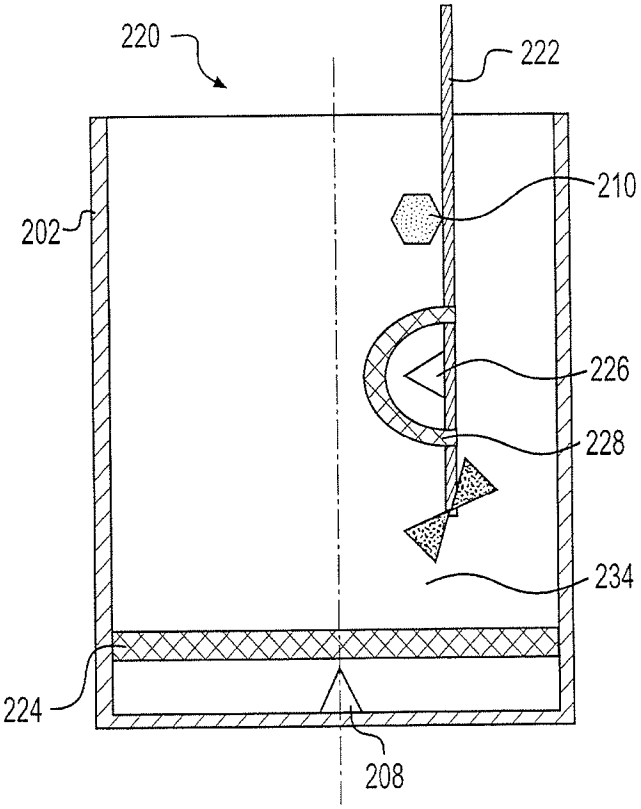
FIGS. 2A and 2B include diagrammatic representations of containers, in accordance with some embodiments of the invention.

The container may further include an inner housing. The inner housing may include a structure at least partially disposed within the outer housing. The inner housing may have a "pot" structure with bottom and side walls or a single wall. The object to be processed may be placed inside an inner volume. An inner volume may include a volume defined by the walls or the contours of the inner housing, or a volume defined by at least one inner housing wall and the outer hosing, as illustrated in FIG. 2B. Even if a portion of the object is placed inside the inner volume—it may be said that the object is placed inside the inner volume. The energy application zone may be at least partially located in the inner housing. In some embodiments, the energy application zone may overlap with the inner volume. Optionally, the object may at least partially come with contact with the inner housing. For example, a soup may be in contact with the inner part of a cooking pot. A radiating element may be associated with the outer housing such that RF energy from at least one radiating element may be transmitted via the inner housing to the inner volume (e.g., the energy application zone). The radiating element may be installed externally to the inner housing. The radiating element may be installed in an interface between the inner housing and the outer housing so as to be isolated from an inner volume of the container by the inner housing. The inner housing may shield and protect the radiating element from the object (e.g., when the object is a soup or a chemical solution), gasses evaporate from the object (e.g. when the object is a food object), etc. The inner volume may be defined as the free space between the shielding or isolating wall, where the object may be placed. The inner housing may be configured to include any material, structure, or shape to meet the requirements of a particular application. For example, in some embodiments, the inner housing may include a single shielding wall, a single shielding element, or several walls and elements. Further, the inner housing may include a shape similar to the shape of the container. In other embodiments, the inner housing may include a shape different from the shape of the container. The inner volume may be defined by at least one wall (e.g., a single wall) provided inside the outer housing.

In some embodiments, at least a portion of the inner housing may be configured to transmit RF energy. For example, the inner housing may comprise at least one part (e.g., one wall of the inner housing or part of one or more walls of the inner housing) comprising an RF transparent material. In some embodiments, the inner housing may include one or more windows (or slots) made from RF transparent material that may be provided in the inner housing (e.g., in one or more walls of inner housing). These windows or slots may allow RF energy to penetrate the inner volume of the container. Optionally, broader sections of the inner housing, or even substantially all of the inner housing, may be constructed from RF transparent material. RF transparent material may include any material capable of transferring at least some EM energy in the RF range. Some examples of RF transparent materials may include: glass, such as tempered soda-lime glass (also known as PYREX), heat resistant polymers, such as Silicone, etc.

In certain embodiments, the application of electromagnetic energy may occur in an "energy application zone", such as energy application zone 9, schematically depicted in FIG. 1. Such an energy application zone may be any suitable void, location, region, or area where electromagnetic energy may be applied. Energy application zone 9 may be located at least partially in a container. Optionally, the energy application zone may be located in the inner volume or inner housing of the container. It may include a hollowed portion, and/or may be partially filled with liquids, solids, gases, or combinations thereof. By way of example only, zone 9 may include an interior of an enclosure, interior of a partial enclosure, open space, solid, or partial solid that allows existence, propagation, and/or resonance of electromagnetic waves. For purposes of this disclosure, all such energy application zones may alternatively be referred to as cavities. It is to be understood that an object is considered "in" the energy application zone if at least a portion of the object is located in the zone, or if some portion of the object receives delivered electromagnetic radiation.

In some embodiments, two or more radiating elements may be located in the container such that a substantially uniform distribution of RF energy may be applied to the energy application zone. In some embodiments, one or more radiating elements may be located in the container such that a substantially uniform distribution of RF energy may be absorbed by an object placed in the energy application zone. A substantially uniform distribution of RF energy may be defined such that a difference in the EM field intensities between different locations in the inner volume may not exceed a threshold. For example, a relative difference between EM field intensities between at least two intensity maxima in at least two different EM field patterns may be determined, and this relative difference between EM field intensities may be compared to a predetermined threshold. In some embodiments, the threshold may be set such that the relative difference between at least two intensity maxima in at least two different EM field patterns may be less than 30%. In other embodiments, the difference may be 20% or even 10% or less. Exemplary embodiments comprising multiple radiating elements for applying a substantially uniform distribution of RF energy are illustrated in FIGS. 3-5 and 9.

FIG. 1 is a diagrammatic representation of an apparatus 100 for applying electromagnetic energy to an object. Apparatus 100 may include a controller 101, an array 102*a* of radiating elements 102 (e.g. antennas), including one or more radiating element, and an energy application zone 9. Controller 101 may include a computing subsystem 92, an interface 130, and an electromagnetic energy application subsystem 96. Based on an output of computing subsystem 92, energy application subsystem 96 may respond by generating one or more radio frequency signals to be supplied to radiating elements 102. In turn, the one or more radiating elements 102 may radiate electromagnetic energy into energy application zone 9. In certain embodiments, this energy can interact with an object 11 positioned within energy application zone 9.

Exemplary energy application zone 9 may include locations where energy is applied in a container, for example: a cooking utensil (e.g., a pot, kettle, pan, etc), a chamber, tank, vat, dryer, thawer, dehydrator, reactor, chemical or biological processing apparatus, incinerator, cooler, freezer, etc. Thus, consistent with some embodiments, energy application zone 9 may include an electromagnetic resonator (also known as cavity resonator).

In certain embodiments, the application of electromagnetic energy may occur via one or more power feeds. A feed may include one or more waveguides and/or one or more radiating elements (e.g., radiating element 102) for delivering electromagnetic energy to the zone. Alternatively, a feed may include any other suitable structure from which electromagnetic energy may be emitted.

In the presently disclosed embodiments, more than one feed and a plurality of radiating elements may be provided. The radiating elements may be located on one or more surfaces of the energy application zone 9 (e.g., radiating elements 206 and 208 illustrated in FIG. 2A). Alternatively, radiating elements may be located inside (e.g., radiating element 226 illustrated in FIG. 2B) or outside the energy application zone 9. The orientation and configuration of each radiating element may be distinct or the same, based on the specific energy application. For example, each radiating element may be positioned, adjusted, and/or oriented to transmit electromagnetic waves along a same direction, or along different directions. Furthermore, the location, orientation, and configuration of each radiating element may be predetermined before applying energy to the object, or dynamically adjusted while applying energy. Moreover, the location, orientation, and configuration of each radiating element may be dynamically adjusted, for example, using a processor during operation of the apparatus, between applications of energy. The invention is not limited to radiating elements having particular structures or located in particular areas or regions.

As schematically depicted in the block diagram of FIG. 1, apparatus 100 may include at least one radiating element 102 in the form of, for example, an antenna for delivery of electromagnetic energy to the energy application zone 9. Radiating element 102 may also be configured to receive electromagnetic energy via the zone 9. In other words, an "antenna," or "radiating element" as otherwise used herein, may function as a transmitter, a receiver, or both, depending on particular application and configuration. The term "antenna" may include traveling-wave antennas that use a traveling wave on a guiding structure as a radiating mechanism. Of these, for example, slow-wave antennas and fast-wave antennas, or leaky-wave antennas, as illustrated for example in FIGS. 5A-5B, may be used. When radiating element 102 acts as a receiver of electromagnetic energy from an energy application zone (e.g., reflected electromagnetic waves), radiating element 102 is said to "receive" electromagnetic energy via the zone 9.

As used herein, the terms "radiating element" and "antenna" may broadly refer to any structure from which electromagnetic energy may radiate and/or be received, regardless of whether the structure was originally designed for the purposes of radiating or receiving energy, and regardless of whether the structure serves any additional function. For example, a radiating element or an antenna may include an aperture/slot antenna, or an antenna which includes a plurality of terminals transmitting in unison, either at the same time or at a controlled dynamic phase difference (e.g., a phased array antenna). Consistent with some exemplary embodiments, radiating elements 102 may include an electromagnetic energy transmitter (referred to herein as "a transmitting antenna") that feeds (supply) energy into electromagnetic energy application zone 9, an electromagnetic energy receiver (referred herein as "a receiving antenna") that receives energy from zone 9, or a combination of both a transmitter and a receiver. For example, a first antenna may be configured to supply electromagnetic energy to zone 9, and a second antenna may be configured to receive energy from the first antenna. Alternatively, multiple antennas may each serve as both receivers and transmitters, and some antennas may serve as both receivers and transmitters while others serve as either transmitters or receivers. So, for example, a single antenna may be configured to both transmit electromagnetic energy to the zone 9 and to receive electromagnetic energy from the zone 9; a first antenna may be configured to transmit electromagnetic energy to the zone 9 and a second antenna may be configured to receive electromagnetic energy via the zone 9; or a plurality of antennas could be used, where at least one of the plurality of antennas is configured to both transmit electromagnetic energy to zone 9 and to receive electromagnetic energy from zone 9. In addition to or as an alternative to transmitting and/or receiving energy, an antenna may be adjusted to affect the field pattern. For example, various properties of the antenna, such as its position, location, orientation, temperature, etc., may be adjusted. Adjusting antenna properties may result in differing electromagnetic field patterns within the energy application zone 9 thereby affecting energy absorption in the object 11. Therefore, antenna adjustments may constitute one or more properties that can be varied in an energy delivery scheme.

In the presently disclosed embodiments, energy may be supplied to one or more transmitting antennas. Energy supplied to a transmitting antenna may result in energy emitted by the transmitting antenna, referred to herein as "incident energy." The incident energy may be delivered to zone 9 and may be equal to the energy supplied to the antennas by a source.

Figure 2A:
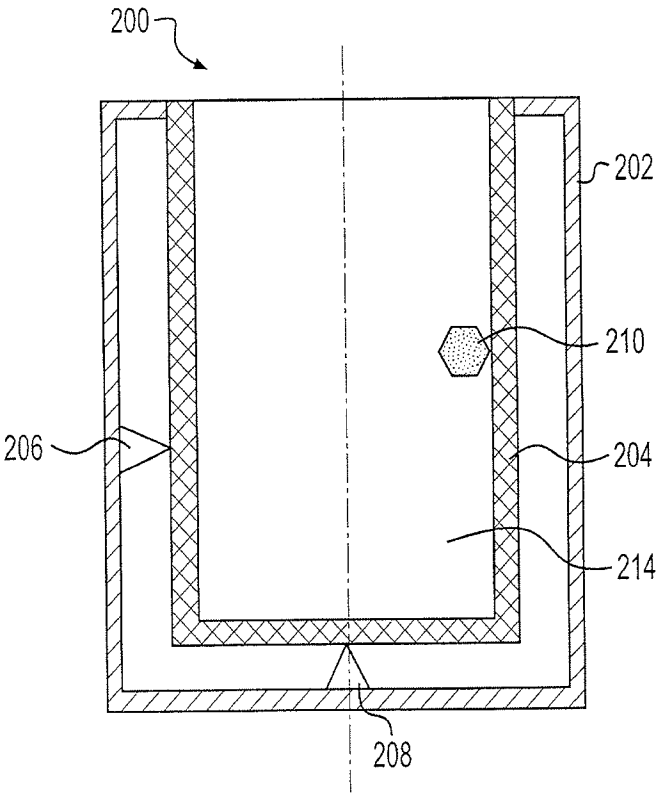

In some embodiments, energy application zone 9 may be at least partially located inside an inner volume of a container, such as containers 200 and 220 illustrated in FIGS. 2A and 2B. FIGS. 2A and 2B depict side sections of containers 200 and 220. The term receptacle or container, as used herein, includes any vessel or container (e.g., vat or tank) or pot used for cooking and/or heating and/or preparing and/or making and/or processing of liquid and/or solids and/or semi-liquid food, for example: soup, steak, sauce, jam, porridge, or yogurt. However, the container (e.g., containers 200 or 220) is not limited for use in heating or preparing food. It may be used, for example, in the preparation of medical fluids or other medical substances, preparation of industrial fluids or other industrial substances, chemical processes and/or for other substances and purposes. In certain embodiments, the receptacle or container may be sealed for containing gaseous material or a combination of gaseous and other material. A container according to the present invention may be constructed such liquid placed therein constitutes a standing liquid that remains substantially within a portion of the container (e.g., the containers illustrated in FIGS. 2-6 and 9), rather than flowing through the container. Although a capability of holding standing liquids may be a property of the container, the invention is not limited to processing liquids. Solid objects or objects having more than one phase (state of matter) may be placed and processed in the container.

Reference is now made to FIGS. 2A and 2B, which illustrate containers according to some embodiments of the invention. Containers 200 and 220 may include outer housing 202. Outer housing 202 may be constructed to be substantially opaque to RF energy. Outer housing 202 may be constructed from alloys, such as, for example, various carbon steels, stainless steels or Al—Si based alloys, or other alloys or conductive materials used in the industry for oven housings. Optionally, outer housing 202 may be constructed from a dielectric material and coated with a layer substantially opaque to RF energy. For example, housing 202 may be constructed from various glasses, heat resistant polymers or ceramics and may be coated with a conductive layer. The conductive layer may include carbon or graphite powder, a metallic layer, or a metallic powder etc. Housing 202 may have a circular, rectangular, hexagonal or any other polygonal cross section, according to the requirements of a particular use.

Container 200 may include inner housing 204. Inner housing 204 may include a structure at least partially disposed within outer housing 202. The object (e.g., object 11) may be placed inside inner housing 204. Inner housing 204 may form inner volume 214 configured to receive an object to be processed. Optionally, the energy application zone may be located at least partially in inner volume 214. In some exemplary embodiments, inner housing 204 may have the structure of an open cylinder or an open prism having any optional polygonal cross section. Inner housing 204 may or may not have the same cross section as outer housing 202. In some embodiments, the inner housing may protrude from the outer housing (not illustrated). For example, outer housing 202 may partially surround the inner housing. Inner housing 204 may be enlarged or partially enlarged in comparison to outer housing 202, e.g. the inner housing may extend beyond the outer housing in one or more directions. Inner housing 204 may be at least partially RF transparent and may include or be made of RF transparent materials, such as, for example, various glasses, heat resistant polymers, ceramics or a combination of several RF transparent materials thereof. In some embodiments, one or more walls of inner housing may include both RF transparent materials and RF impermeable materials. For example, inner housing 204 wall(s) may be made of an RF impermeable material and may include at least one RF transparent window (not illustrated) configured to allow RF radiation to enter inner volume 214 and process the object. The RF transparent window(s) may be installed in inner housing 204 wall(s) in proximity to the radiating elements (e.g., elements 206 and 208).

Container 200 may further include at least one radiating element (e.g., elements 206 and 208) configured to apply RF energy to the energy application zone (e.g., to inner volume 214). The at least one radiating element may be associated with outer housing 202. In some embodiments, at least one radiating element may be provided externally to inner housing 204, for example, in a volume between the inner housing 204 and the outer housing 202. For example, radiating element 206 may be installed (provided) in the volume between the inner and outer housing side wall(s). Additionally or alternatively, radiating element 208 may be installed in the volume between the inner and outer housing bottom and/or top wall (s) (for example—radiating element 208). Radiating elements 206 and 208 may be for example: any RF antenna, waveguides, slows wave antennas, etc. A slow-wave antenna may refer to a wave-guiding structure that possesses a mechanism that permits it to emit power along all or part of its length. The slow wave antenna may comprise a plurality of slots to enable electromagnetic (EM) energy to be emitted. In some embodiments, a coupling may be formed between an evanescent EM wave (e.g., emitted from a slow wave antenna) and an object placed in the container (e.g., in inner volume). An evanescent EM wave in free space (e.g., in the vicinity of the slow wave antenna) may be non-evanescent in the object.

In some embodiments, container 200 may further include at least one sensor (e.g., sensor 210). Sensor 210 may be configured to sense physical properties of the object placed in inner volume 214. For example, sensor 210 may sense and monitor the temperature, pressure, pH level, chemical composition, viscosity, fluidity, humidity level etc. In some embodiments, sensor 210 may be in communication (by-wire or wirelessly) with a processor associated with container 200. In some embodiments, the processor may adjust energy application in the container (e.g., in inner volume 214) based on the sensor measurements. In some embodiments, sensor 210 may directly detect or indirectly determine EM feedback received from the energy application zone. In some embodiments more than one sensor may be installed in container 200.

Reference is now made to container 220 illustrated in FIG. 2B. Container 220 may include outer housing 202, as discussed with respect to FIG. 2A. Container 220 may include inner housing 224. Inner housing 224 may have a shape of at least one wall of outer housing 202 and may be installed at least partially inside outer housing 202. Inner housing 224 may include a wall parallel (or at least partially or generally parallel) to at least one side (e.g., bottom or top sides) of container 220. For example, as illustrated in FIG. 28, inner housing 224 may have a shape similar to the bottom wall of outer housing 202 and may include a wall generally parallel to the bottom wall of outer housing 202. Together with outer housing 202, inner housing 224 may form inner volume 234. In the embodiment illustrated in FIG. 2B, inner volume 234 may be defined as the space between inner housing wall 224 and walls of outer housing 202. Inner volume 234 may be configured to receive an object to be processed in container 220. Inner housing 224 may be constructed from an RF transparent or partially transparent material. Optionally, inner housing 224 may be made of RF impermeable material and may include at least one RF transparent window.

In some embodiments, the inner housing may include an RF transparent shielding 228, located on an external device placed in the container, such as stirrer 222, for example. Shielding 228 may shield radiating element 226 located on stirrer 222 from the object placed in inner volume 234. In the embodiment illustrated in FIG. 2B, inner volume 234 may be defined as the space between outer housing 202 walls, inner housing wall 224 and shielding 228. In some embodiments, both inner housing 224 and shielding 228 may be installed in a container. In some embodiments, container 200 illustrated for example in FIG. 2A may further include additional external apparatus, for example stirrer 222. Container 200 may include additional radiating element 226 located on stirrer 222 and shielding 228. Stirrer 222 (e.g., a mixer) may be used to stir and/or to mix the objects to be heated or other processing by EM energy. For example, when preparing a jam or porridge, it may be required to blend the jam or porridge. In some embodiments, the application of EM energy may be interrupted so that stirring may be conducted, e.g. stirring is conducted between sessions of EM energy application. For example, the application of EM energy may be interrupted every 0.5-10 min, e.g. every 5 min. In other embodiments, stirring may be conducted simultaneously with application of EM energy. In such cases, stirrer 222 may be comprised of RF transparent material. In some embodiments, the stirring element, stirrer and/or a mixer may be made from a non-conductive material, e.g. Teflon or polyether ether ketone (PEEK). In some embodiments, stirrer 222 may comprise material having a dielectric constant, ∈r, similar to dielectric constants of the objects, (e.g., for food objects ∈r=40, 50, 60, 80). In some embodiments, the container (e.g., container 200 or 220) may be provided with venting (not illustrated) for allowing vapor to exit the container. In some embodiments, a venting unit comprising a mesh may be may be provided in the container for allowing vapor to exit the container. The mesh may be substantially opaque to RF energy and/or sealed to RF. For example, the holes of the mesh may be smaller than the wavelength of the EM energy delivered to the energy application zone (e.g., inner volume). The mesh may be provided, for example, in cover 604 or 624 illustrated in FIGS. 6A and 6B. Additionally or alternatively, blowers may be provided to increase the rate of evaporation.

Container 220 may further include radiating element(s). For example, container 220 may include radiating element 208, located at the space between inner housing 224 and outer housing 202, e.g., below wall of inner housing 224. Container 220 may also include radiating element 226 located on the external device (e.g., stirrer 222). Elements 208 and 226 may include any radiating element configured to apply RF energy to inner volume 234 to process an object placed in inner volume 234, according to some embodiments of the invention. Container 220 may further include at least one sensor (e.g., sensor 210). Sensor 210 may be configured to sense physical properties of the object placed in inner volume 234, is similar manner as the one disclosed above.

Figure 3B:
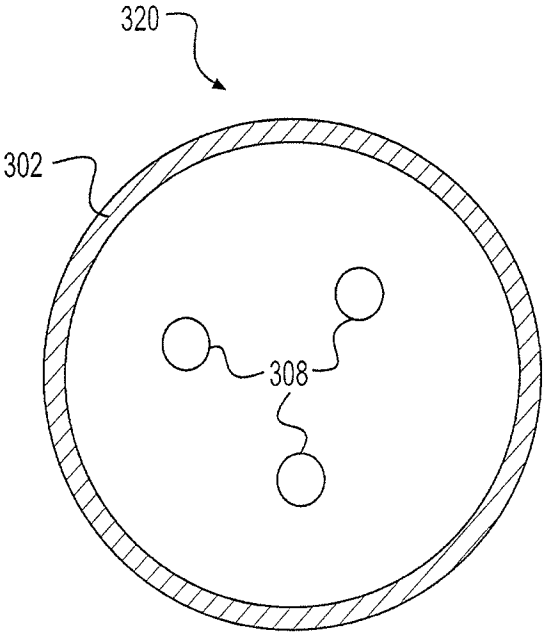
FIGS. 3A and 3B include diagrammatic representations of optional locations of radiating element(s) within a container, in accordance with some embodiments of the invention.
Figure 3A:
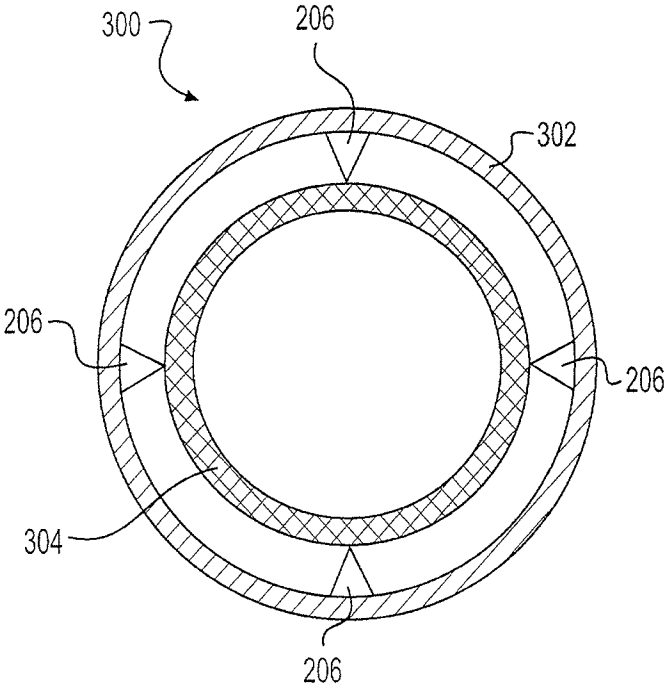

More than one radiating element may be installed at various places in the container. Some examples are illustrated in FIGS. 3A and 3B. FIGS. 3A and 3B provide top view cross sections of containers 300 and 320, in accordance with some embodiments of the invention. As matter of convenience, containers 300 and 320 are illustrated as having a circular cross section; however the invention is not limited to any particular cross section. For example, the container may have a rectangular cross section. Container 300 may include four radiating elements 206 provided in the space between outer housing 302 and inner housing 304. The four elements illustrated in FIG. 3A represent an exemplary embodiment only. The invention is not limited to any particular number of radiating elements installed or located in a container. Elements 206 may be connected to outer housing 302 and/or inner housing 304. Elements 206 may be installed at any height between the bottom and the top sides of container 300. Radiating elements 201 may be installed at the same height (with respect to the bottom side of the container) or may be at different heights. In some embodiments, elements 206 may be installed in other regions in the space between outer housing 302 and inner housing 304, not necessarily in a symmetrical manner (as illustrated in FIG. 3A). Radiating element 206 may include any element configured to apply RF energy to an energy application zone in accordance with some embodiments of the invention.

In some embodiments, more than one radiating element may be installed between outer housing 302 and the inner housing wall (e.g., housing wall 224 illustrated in FIG. 2B). Referring to FIG. 3B, radiating elements 308 may be installed at one side of the container (e.g., bottom side). FIG. 3B illustrates a top section view of container 320 having radiating element(s) provided in its bottom space, for example: in the interface between outer and inner housing of container 320 (similar to the illustration of radiating element 208 in FIGS. 2A and 2B). Radiating elements 308 may be symmetrically or asymmetrically placed at the bottom of container 320. Radiating element 308 may include any element configured to apply RF energy to an energy application zone in accordance with some embodiments of the invention.

Figure 4B:
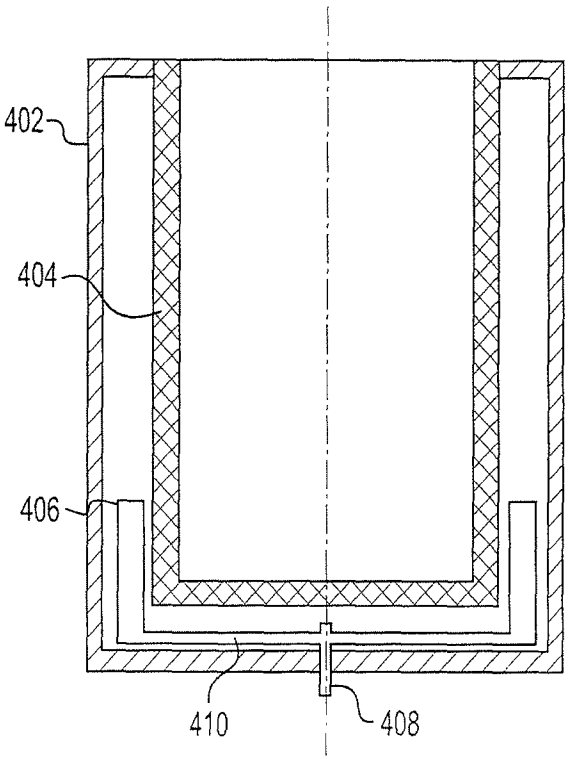
FIGS. 4A and 4B include diagrammatic representations of a top section and a side section of a container, in accordance with some embodiments of the invention.
Figure 4A:
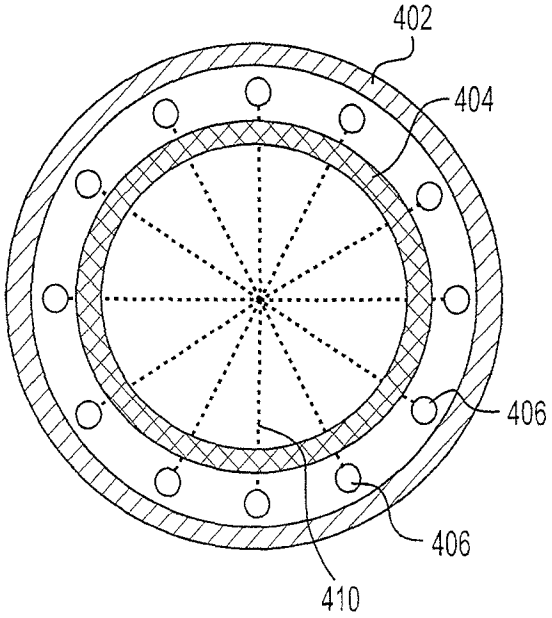

Reference is now made to FIGS. 4A and 4B illustrating top view and side view cross sections of exemplary container 400, according to some embodiments of the invention. Container 400 may include cylindrical outer housing 402 which may be substantially opaque to RF energy, for example—constructed from of a metallic alloy (e.g., Al—Si alloys, stainless steels etc.). Cylindrical inner housing 404 may be at least partially disposed inside outer housing 402. Inner housing 404 may be constructed from RF transparent material, e.g., Pyrex. Container 400 may further include 12 radiating elements 406. Radiating elements 406 may be supplied with RF energy from a single feed 408. In some embodiments, more than one feed may be used, for example: radiating elements 406 may be divided into group, wherein each group is connected to its respective feed. Elements 406 may be connected to feed 408 via feeding lines 410. Feeding lines 410 are illustrated in dashed lines to indicate that the lines may be placed below a bottom wall of inner housing 404, as shown in FIG. 4B. Feed 408 may be further connected to a power supply (not illustrated) configured to supply RF energy to elements 406.

Figure 8A:
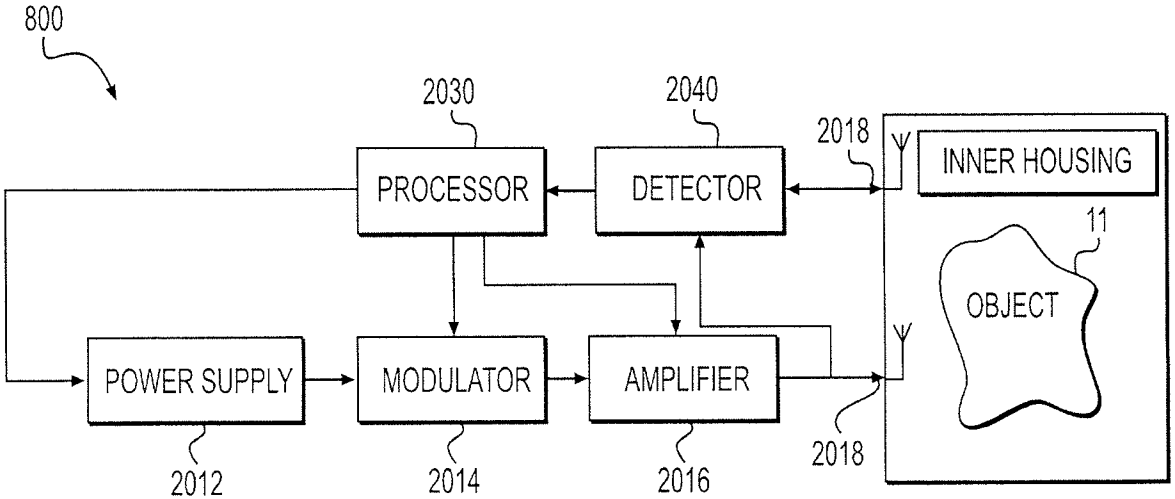
FIG. 8A is a diagrammatic representation of an apparatus for applying electromagnetic energy to an energy application zone, in accordance with some embodiments of the present invention.

Additional components, e.g., power supply 2012, processor 2030 etc., which are described in reference to apparatus 800 of FIG. 8A may be provided in containers 200, 220, 300, 320, and 400. For example, a power supply may be provided below a bottom surface of outer housing 202, 302 or 402. Additionally or alternatively, a power supply may be provided below a bottom surface of inner housing 204, 224, 304 or 404, i.e. inside outer housing 202, 302 and 402 etc.

Figure 5B:
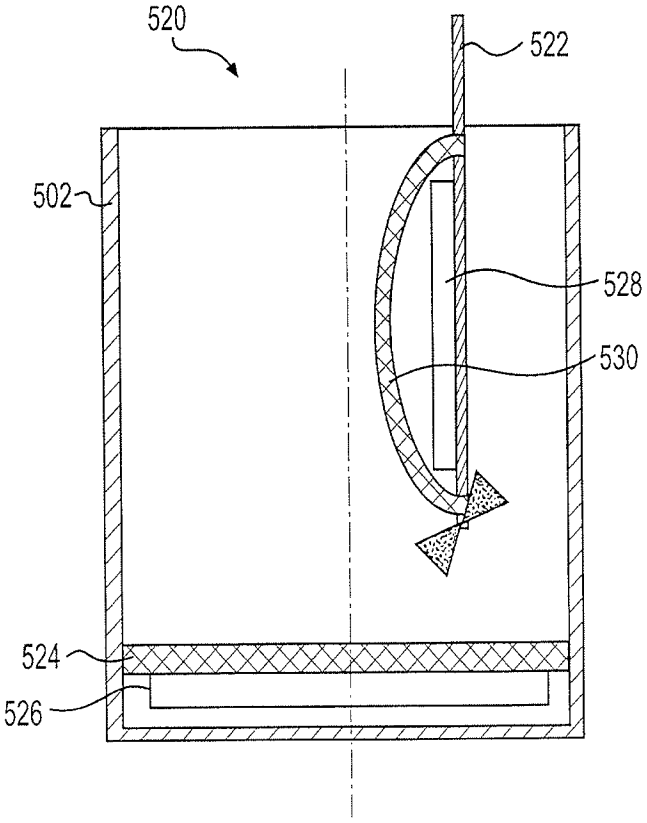
FIGS. 5A-5C include diagrammatic representations of optional locations of waveguides in a container, in accordance with some embodiments of the invention.
Figure 5A:
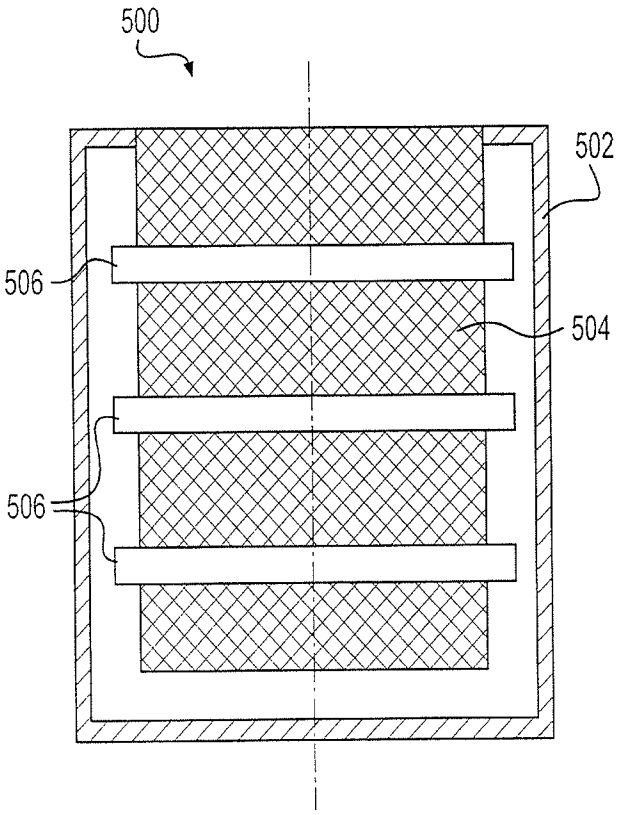
Figure 5C:
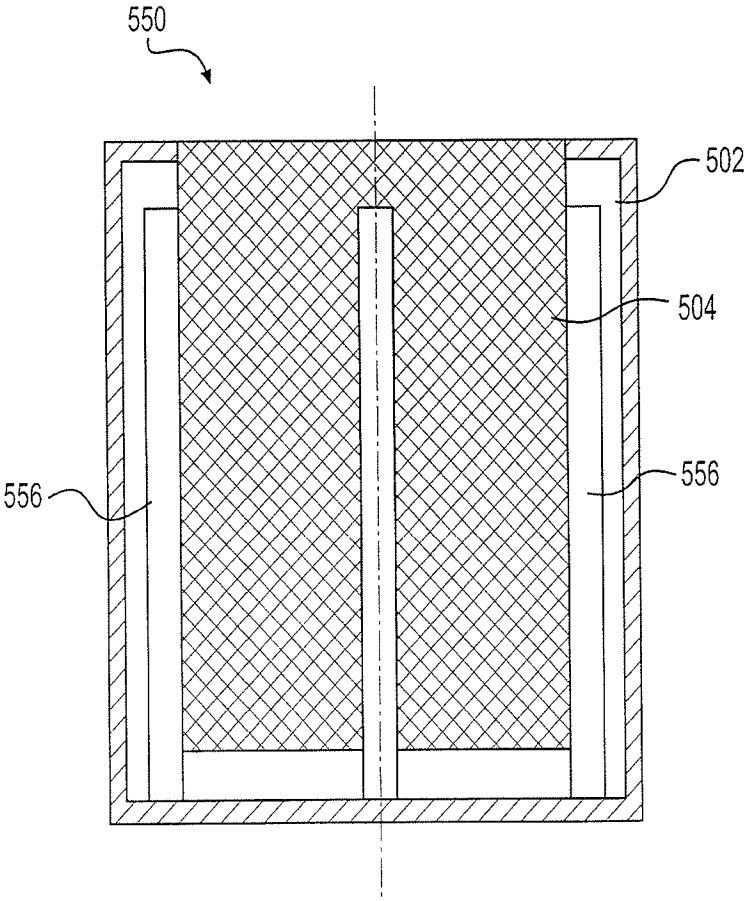

In some embodiments, the RF energy may be applied to the container by a waveguide. The term waveguide used herein may refer to any: waveguide, slotted waveguide, leaky wave antenna, slow wave antenna, etc. configured to apply RF energy to an energy application zone. Some exemplary containers including waveguides are illustrated in FIGS. 5A-5C. Although the waveguides illustrated in FIGS. 5A-5C are shown to have rectilinear edges, in fact, waveguides 506, 526, 528, and 556 may have any suitable shape. For example, waveguides 506, 526, 528, and 556 may have rounded edges, convex edges and/or other shaped edges.

Reference is now made to FIG. 5A illustrating container 500 in accordance with some embodiments of the invention. FIG. 5A provides a side view cross section of container 500. The view shown provides a side view of inner housing 504 residing within outer housing 502. Outer housing 502 and inner housing 504 may be constructed in accordance with some of the embodiments disclosed above. Outer and inner housing may have a cylindrical or a prism shape. Container 500 may further include three waveguides 506 in strips or tube form, installed around inner housing 504 at various heights with respect to container 500. Waveguides 506 may be located between inner housing 504 and outer housing 502.

Another exemplary container including waveguides is illustrated in FIG. 5B. FIG. 5B provides a side view cross section of container 520. Container 520 may include outer housing 502 and inner housing 524. Outer housing 502 and inner housing 524 may be substantially similar to outer housing 202 and inner housing 224 disclosed with respect to FIG. 2B. Container 520 may include stirrer 522, that may be substantially similar to stirrer 222, and may also include shielding 530 that may be substantially similar to shielding 228, both illustrated in FIG. 2B. Container 520 may further include waveguide 526. Waveguide 526 may be installed between the bottom (or top side) of outer housing 502 and inner housing 524, e.g., below an inner housing wall.

Waveguide 526 may configured a straight line or a circle. In some embodiments, more than one straight waveguide and/or more than one circular waveguide may be installed in container 520. Additionally or alternatively, waveguide 528 may be installed on stirrer 522 and covered by shielding 530.

A third exemplary container comprising a plurality of waveguides is illustrated in FIG. 5C, in accordance with some embodiments of the invention. FIG. 5C is side view cross section of container 550, which shows inner housing 504 within outer housing 502. Outer housing 502 and inner housing 504 may be similar to the respective elements disclosed with respect to FIG. 5A. Container 550 may further include at least one straight waveguide 556 installed perpendicular to the bottom of container 550. It is to be understood that, although three waveguides (506 and 556) are shown in FIGS. 5A and 5C, any suitable number of waveguides may be used. FIG. 5C shows each waveguide 556 oriented perpendicularly with respect to the bottom of the inner housing 504. However, each waveguide 556 may take any other suitable orientation (e.g., diagonal, horizontal, etc.).

Figure 6B:
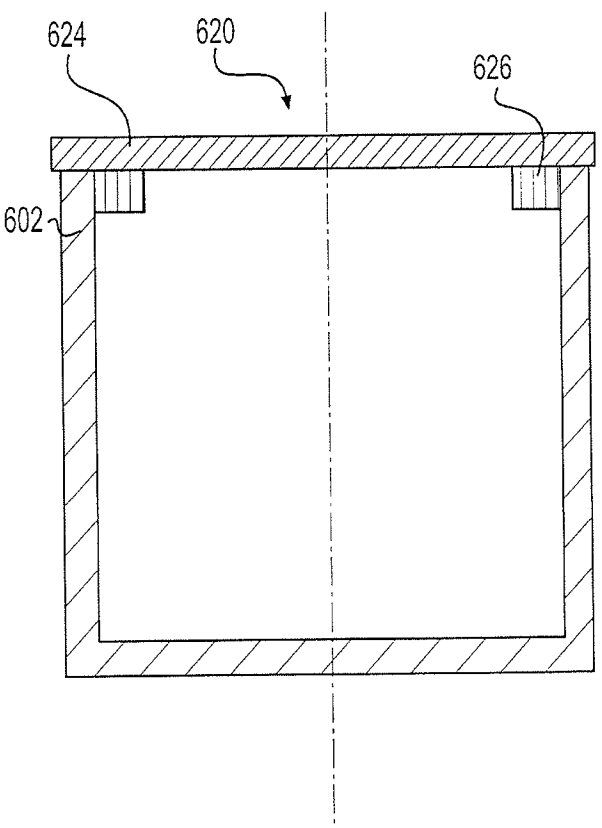
FIGS. 6A and 6B include diagrammatic representations of containers provided with a cover, in accordance with some embodiments of the invention.
Figure 6A:
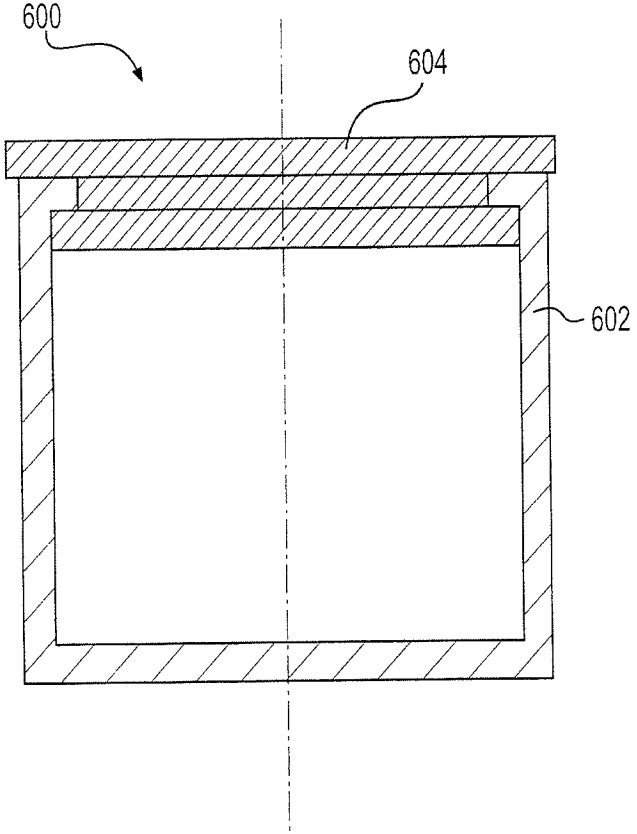

FIGS. 6A and 6B provide representations of containers 600 and 620, in accordance with some embodiments of the invention. FIGS. 6A and 6B provide side view cross sections of containers 600 and 620 including an outer housing and a top or a cover. Containers 600 and 620 may further include other components which are not illustrated (e.g., inner housing, radiating element(s), external device(s), power supply, a processor, etc. as discussed broadly with respect to FIGS. 1 and 8A). Outer housing 602 may be constructed according to some embodiments disclosed in the present invention.

Container 600 may comprise outer housing 602 covered by cover 604. Cover 604 may be designed to seal or at least partially block container 600 from heat and vapor run (e.g., escaping outside the container) and/or to reduce or prevent RF energy leakage. Cover 604 may be pressed during sealing against outer housing 602 in a similar manner to the sealing of a pressure cooker. When a good contact between cover 604 and housing 602 may be achieved, vapors may be maintained within container 600. Cover 604 may be constructed from an RF opaque material, for example a metal. When cover 604 is pressed against outer housing 602, an electric contact may be formed between outer housing 602 and cover 604, which may result in little or no RF energy leakage from container 604.

Reference is now made to FIG. 6B illustrating container 620 in accordance with some embodiments of the invention. Container 620 may include outer housing 602 and cover 624. Cover 624 may be placed on top of container 620 in a manner similar to the cover of a conventional pot. In order to reduce or prevent RF energy leakage from container 620, choke 626 may be installed in cover 624 or the upper inner part of container 620. Choke 626 may include any chock or a chock system configured to reduce or prevent RF radiation leakage. Choke 626 may be configured to block or reduce RF energy leakage at a single frequency or at a band of frequencies. In some embodiments, more than one choke may be provided in container 620—for example: a first choke may be provided on cover 624, and a second choke may be provided in outer housing 602. In some embodiments, the choke(s) may be configured to attenuate the same frequency or the same frequency band. Optionally, each choke may be configured to attenuate a different frequency or a different frequency band.

Figure 7:
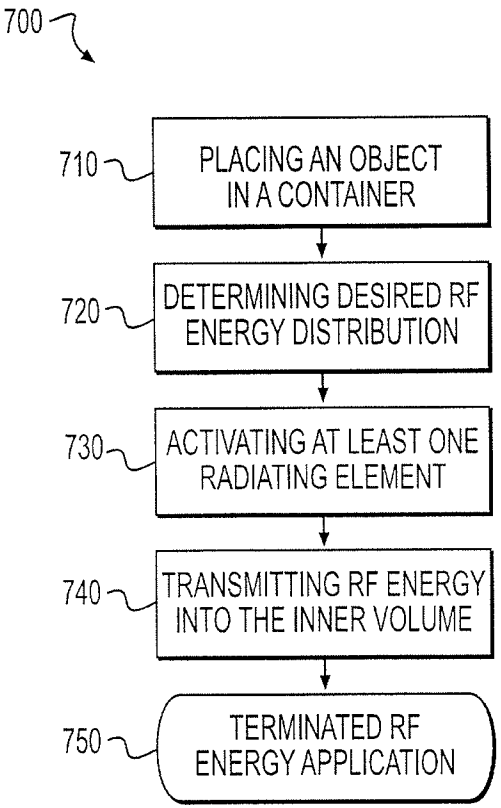
FIG. 7 is a flowchart presenting a method for applying RF energy to a container, in accordance with some embodiments of the invention.

Reference is now made to FIG. 7 presenting method 700 for applying RF energy to an object placed in a container in order to process the object, in accordance with some embodiments of the invention. An object to be processed may be placed in a container, in step 710. For example, the object to be processed may include a food item to be cooked, roasted, or baked (e.g., soup, yogurt, eggs, steaks, bread, cake, etc.), and the container may include a cooking utensil (e.g., an oven, a pot, a poyke, a kettle, etc.). In some embodiments, a desired RF energy distribution (e.g., within an inner volume or within an energy application zone) may be determined in step 720. In some embodiments, the RF energy distribution may be pre-determined, e.g., may be determined at a manufacturing site of the container such that the predetermined energy distribution may be applied when the RF energy source operates. In some embodiments, the RF energy distribution may not be determined—for example—in containers in which RF energy distribution may not be controlled or adjusted. For example, substantially homogeneous RF energy distribution may be applied to the entire volume of the container when liquids (e.g., beer, chemical solution, etc.) are placed in the inner volume of the container. Substantially homogeneous RF energy distribution may be achieved by installing the radiating element(s) around the walls of the outer housing such that the EM energy field pattern excited in the inner volume may form relatively uniform EM field intensity distribution in the inner volume (or the inner housing). The EM energy field pattern may be excited by transmitting RF energy (e.g., RF waves) from each radiating element(s) to the inner volume. Some exemplary containers for applying homogeneous RF energy distribution are illustrated in FIGS. 3A, 4 and 5A (i.e., containers 300, 400 and 500). Additionally or alternatively, substantially homogeneous RF energy distribution may be achieved by applying RF energy using a plurality of MSEs (e.g. a plurality of frequencies and/or phases). Modulation space elements (MSEs) will be discussed broadly below. In some embodiments, RF energy may be applied at a plurality of MSEs (e.g., frequencies). Applying RF energy via at least one radiating element at a plurality of frequencies may result in creating different EM field patterns in the container at each frequency (e.g., at each frequency the area of maximum intensity may be located at a different place in the container), thus applying RF energy to different locations in the container. This may result in a substantially homogeneous RF energy distribution in inner volume. In some embodiments, RF energy may be applied to a container via two or more radiating elements, and a phase difference may be applied between two radiating elements applying RF energy the same frequency at the same time.

Alternatively, a controlled non homogeneous RF energy distribution may be applied to the container when different amounts of RF energy are required at different locations within the container, e.g., within an inner volume. For example, cooking various food items together in a cooking container (e.g. a cooking utensil) may require different amounts of energy to be applied to different food items. A soup may include water and solid ingredients such as vegetables, herbs and chicken or fish. The solid ingredients may be collected in the bottom part of the container (due to gravitation) and may require a higher amount of energy that the water component to be cooked. A container may be constructed such that the radiating element(s) may be installed at the bottom or lower part of the container (e.g., containers 320 illustrated in FIG. 3B and container 520 illustrated in FIG. 5B), designed to apply more energy to the bottom part of the container—e.g., to the solid ingredients of the soup. Additionally or alternatively, a controller (e.g., controller 101 or processor 2030) may be configured to cause the excitation of at least one field pattern designed to apply RF energy to a particular location(s) within the inner housing in order to heat a particular portion(s) of the object. The controller may choose to apply a specific frequency and optionally to determine a phase difference between two or more radiating elements (when more than one radiating element is installed in the container) applying the same frequency at the same time.

Radiating element(s) (e.g., elements 102, 206, 226, 308, 406, 506, 526 and 528) may be activated by providing (supplying) power to the radiating element(s) from a power source, in step 730. In some embodiments, more than one power source may be used. The power source may include a magnetron, a solid state amplifier or any other power source configured to supply RF energy. Radiating element(s) may be configured to apply RF energy to an energy application zone within the inner housing of the container (e.g., inner volumes 214 and 234). Radiating element(s) may be associated with an outer housing of the container (e.g., outer housing 202, 402 and 502). In response to the power being provided to the radiating element(s), the radiating element(s) may transmit RF energy to the inner volume, at step 740. The inner housing of the container may be at least partially configured to transmit RF energy from the radiating element(s) into the inner volume. When the processed object has reached the desired result (e.g., the soup is ready or the food is at a desired temperature), the RF energy may be terminated, at step 750. Termination of RF energy application may be done by terminating the energy supply from the power source to the radiating elements.

Radiating elements, e.g., elements 206, 208, 226, 308, 406, 506, 526, 528, 556, may be configured to feed energy at specifically chosen modulation space elements, referred to herein as MSEs, which are optionally chosen by controller 101. The term "modulation space" or "MS" is used to collectively refer to all the parameters that may affect a field pattern in the energy application zone (e.g., inner volume 214 and 234) and all combinations thereof. In some embodiments, the "MS" may include all possible components that may be used and their potential settings (absolute and/or relative to others) and adjustable parameters associated with the components. For example, the "MS" may include a plurality of variable parameters, the number of antennas (radiating elements), their positioning and/or orientation (if modifiable), the useable bandwidth, a set of all useable frequencies and any combinations thereof, power settings, phases, etc. The MS may have any number of possible variable parameters, ranging between one parameter only (e.g., a one dimensional MS limited to frequency only or phase only—or other single parameter), two or more dimensions (e.g., varying frequency and amplitude or varying frequency and phase together within the same MS), or many more.

Each variable parameter associated with the MS is referred to as an MS dimension. By way of example, an MS may have three dimensions designated as frequency (F), phase (P), and amplitude (A). That is, frequency, phase, and amplitude (e.g., an amplitude difference between two or more waves being transmitted at the same time) of the electromagnetic waves are modulated during energy delivery, while all the other parameters may be fixed during energy delivery. The MS may have any number of dimensions, e.g., one dimension, two dimensions, three dimension, four dimensions, n dimensions, etc. In one example, a one dimensional modulation space oven may provide MSEs that differ one from the other only by frequency.

The term "modulation space element" or "MSE," may refer to a specific set of values of the variable parameters in MS. Therefore, the MS may also be considered to be a collection of all possible MSEs. For example, two MSEs may differ one from another in the relative amplitudes of the energy being supplied to a plurality of radiating elements. For example, a three-dimensional MSE may have a specific frequency F(i), a specific phase P(i), and a specific amplitude A(i). If even one of these MSE variables changes, then the new set defines another MSE. For example, (3 GHz, 30°, 12 V) and (3 GHz, 60°, 12 V) are two different MSEs, although only the phase component is different.

Differing combinations of these MS parameters will lead to differing field patterns across the energy application zone and differing energy distribution patterns in the object. For example, when different amount of energies are required at different locations/portions of the object, e.g., for cooking soup with solid ingredients, or for coking 6 eggs to different doneness levels. A plurality of MSEs that can be executed sequentially or simultaneously to excite a particular field pattern in the energy application zone may be collectively referred to as an "energy delivery scheme." For example, an energy delivery scheme may consist of three MSEs: (F(1), P(1), A(1)); (F(2), P(2), A(2)) (F(3), P(3), A(3)). Such an energy application scheme may result in applying the first, second, and third MSE to the energy application zone.

The invention, in its broadest sense, is not limited to any particular number of MSEs or MSE combinations. Various MSE combinations may be used depending on the requirements of a particular application and/or on a desired energy transfer profile, and/or given equipment, e.g., inner housing dimensions. The number of options that may be employed could be as few as two or as many as the designer desires, depending on factors such as intended use, level of desired control, hardware or software resolution and cost.

In certain embodiments, there may be provided at least one processor. As used herein, the term "processor" may include an electric circuit that performs an operation on input or inputs. For example, such a processor may include one or more integrated circuits, microchips, microcontrollers, microprocessors, all or part of a central processing unit (CPU), graphics processing unit (GPU), digital signal processors (DSP), field-programmable gate array (FPGA) or other circuit suitable for executing instructions or performing logic operations.

The instructions executed by the processor may, for example, be pre-loaded into the processor or may be stored in a separate memory unit such as a RAM, a ROM, a hard disk, an optical disk, a magnetic medium, a flash memory, other permanent, fixed, or volatile memory, or any other mechanism capable of storing instructions for the processor. The processor(s) may be customized for a particular use, or can be configured for general-purpose use and can perform different functions by executing different software.

If more than one processor is employed, all may be of similar construction, or they may be of differing constructions electrically connected or disconnected from each other. They may be separate circuits or integrated in a single circuit. When more than one processor is used, they may be configured to operate independently or collaboratively. They may be coupled electrically, magnetically, optically, acoustically, mechanically or by other means permitting them to interact.

The at least one processor may be configured to cause electromagnetic energy to be applied to zone 9 (e.g., inner volume 214 and 234) via one or more radiating elements (e.g., elements 206, 208, 226, 308, 406, 506, 526, 528, 556) across a series of swept MSEs, attempting to apply electromagnetic energy at each such MSE to an object 11. For example, the at least one processor may be configured to regulate one or more other components of controller 101 in order to activate at least one radiating element and to cause the element to transmit RF energy to the energy application zone.

The at least one processor may work in conjunction with and/or be a part of controller 101. As illustrated in FIG. 1, for example, apparatus 100 may include, a controller 101 electrically coupled to one or more radiating elements 102. As used herein, the term "electrically coupled" refers to one or more direct or indirect electrical connections. An indirect electrical connection may occur, for example, when the controller influences energy transmitted from an antenna through one or more intermediate components. When a controller is connected to a transmitting element through one or more intermediated components, devices, circuits, or interfaces, the controller is said to be electrically coupled to the element indirectly. When the controller connects to the radiating element without any intermediate structure, the controller is said to be electrically coupled to the radiating element directly.

Controller 101 may include various components or subsystems configured to control the application of electromagnetic energy through one or more radiating elements 102. For example, controller 101 may include a computing subsystem 92, an electromagnetic energy application subsystem 96, and an interface between subsystems 92 and 96. Consistent with the presently disclosed embodiments, computing subsystem 92 may be a general purpose or special purpose computer. Computing subsystem 92 may be configured to generate control signals for controlling electromagnetic energy application subsystem 96 via interface 130. Computing subsystem 92 may further receive measured signals from electromagnetic energy application subsystem 96 via interface 130.

While controller 101 is illustrated for exemplary purposes as having three subcomponents, control functions may be consolidated in fewer components, or additional components may be included consistent with the desired function and/or design of a particular embodiment. As described herein, controller 101 may be configured to perform various functions/processes for applying electromagnetic energy to zone 9.

In certain embodiments, the at least one processor may be configured to determine a value indicative of energy absorbable by the object at one or more MSEs. The determination may occur using one or more lookup tables, by pre-programming the processor or memory associated with the processor, and/or by testing an object in an energy application zone to determine its absorbable energy characteristics. One exemplary way to conduct such a test is through a sweep of MSEs.

As used herein, the word "sweep" includes, for example, the transmission over time of more than one MSE. For example, a sweep may include the sequential transmission of multiple MSEs in a contiguous MSE band; the sequential transmission of multiple MSEs in more than one non-contiguous MSE band; the sequential transmission of individual non-contiguous MSEs; and/or the transmission of synthesized pulses having a desired MSE/power spectral content (i.e. a synthesized pulse in time). Thus, during an MSE sweep, the at least one processor may regulate the energy supplied to the at least one antenna to sequentially transmit electromagnetic energy at various MSEs to zone 9, and to receive feedback serving as an indicator of the energy absorbable by object 11. While the invention is not limited to any particular measure of feedback indicative of energy absorption in the object, various exemplary indicative values are discussed below.

During an MSE sweep, electromagnetic energy application subsystem 96 may be configured to receive electromagnetic energy reflected and/or coupled at radiating element(s) 102, and to communicate the measured energy information back to subsystem 92 via interface 130, as illustrated in FIG. 1. Subsystem 92 may be configured to determine a value indicative of energy absorbed by object 11 at each of a plurality of MSEs based on the received information. Consistent with the presently disclosed embodiments, a value indicative of the capacity to absorb energy may be a dissipation ratio (referred to herein as "DR") associated with an MSE. As referred herein, a "dissipation ratio," also known as "absorption efficiency" or "power efficiency," may be defined as a ratio between electromagnetic energy absorbed by object 11 and electromagnetic energy supplied into electromagnetic energy application zone 9.

Energy that may be dissipated or absorbed by an object is referred to herein as "absorbable energy." Absorbable energy may be an indicator of the object's capacity to absorb energy or the ability of the apparatus to cause energy to dissipate in a given object. In the presently disclosed embodiments, absorbable energy may be calculated as a product of the maximum incident energy supplied to the at least one antenna and the dissipation ratio. Reflected energy (i.e., the energy not absorbed or coupled) may, for example, be a value indicative of energy absorbed by the object or other load. By way of another example, a processor might calculate or estimate absorbable energy based on the portion of the incident energy that is reflected and the portion that is coupled. That estimate or calculation may serve as a value indicative of absorbed energy.

During a MSE sweep, for example, the at least one processor might be configured to control a source of electromagnetic energy such that energy is sequentially supplied to an object 11 at a series of MSEs. The at least one processor might then receive a signal indicative of energy reflected at each MSE, and optionally also a signal indicative of the energy transmitted to other antennas. Using a known amount of incident energy supplied to the antenna and a known amount of energy reflected and/or coupled (i.e., thereby indicating an amount absorbed at each MSE) an absorbable energy indicator might be calculated or estimated. Alternatively, the processor might simply rely on an indicator of reflection as a value indicative of absorbable energy.

Absorbable energy may also include energy that may be dissipated by the structures of the energy application zone in which the object is located. Because absorption in metallic or conducting material (e.g., the outer housing walls or elements within the container) is characterized by a large quality factor (also known as a "Q factor"), such MSEs may be identified as being coupled to conducting material. At times, a choice may be made not to transmit energy in such sub bands. In that case, the amount of electromagnetic energy absorbed in the outer or inner housing walls may be substantially small, and thus, the amount of electromagnetic energy absorbed in the object 11 may be substantially equal to the amount of absorbable energy.

In the presently disclosed embodiments, a dissipation ratio may be calculated using formula (1):

$$DR=(P_{in}-P_{rf}-P_{cp})/P_{in} \quad (1)$$

where $P_{in}$ represents the electromagnetic energy supplied into zone 9 by antennas 102, $P_{rf}$ represents the electromagnetic energy reflected/returned at those antennas that function as transmitters, and $P_{cp}$ represents the electromagnetic energy coupled at those antennas that function as receivers. DR may be a value between 0 and 1, and, in the presently disclosed embodiments, may be represented by a percentage.

For example, consistent with an embodiment which is designed for three antennas 1, 2, and 3 (e.g., elements 308 illustrated in FIG. 3B), subsystem 92 may be configured to determine input reflection coefficients $S_{11}$, $S_{22}$, and $S_{33}$ and the transfer coefficients $S_{12}=S_{21}$, $S_{13}=S_{31}$, $S_{23}=S_{32}$ based on the measured power information during the sweep. Accordingly, the dissipation ratio DR corresponding to antenna 1 may be determined based on these coefficients, according to formula (2):

$$DR=1-(IS_{11}I^2+IS_{12}I^2+IS_{13}I^2). \quad (2)$$

The value indicative of the absorbable energy may further involve the maximum incident energy associated with a power amplifier (not illustrated) of subsystem 96 at an MSE. As referred herein, a "maximum incident energy" may be defined as the maximal power that may be provided to the antenna at a given MSE throughout a given period of time. Thus, one alternative value indicative of absorbable energy may be the product of the maximum incident energy and the dissipation ratio. These are just two examples of values that may be indicative of absorbable energy which could be used alone or together as part of control schemes implemented in controller 101. Alternative indicia of absorbable energy may be used, depending on the structure employed and the application.

In certain embodiments, the at least one processor may also be configured to cause energy to be supplied to the at least one radiating element in at least a subset of the plurality of MSEs, wherein energy transmitted to the zone at each of the subset of MSEs may be a function of the absorbable energy value at each MSE. For example, the energy supplied to the at least one radiating element 102 at each of the subset of MSEs may be determined as a function of the absorbable energy value at each MSE (e.g., as a function of a dissipation ratio, maximum incident energy, a combination of the dissipation ratio and the maximum incident energy, or some other quantity). In the presently disclosed embodiments, this may occur as the result of absorbable energy feedback obtained during an MSE sweep. That is, using this absorbable energy information, the at least one processor may adjust energy supplied at each MSE such that the energy at a particular MSE may in some way be a function of an indicator of absorbable energy at that MSE. The functional correlation may vary depending upon a particular application. For some applications where absorbable energy is relatively high, there may be a desire to have the at least one processor implement a function that causes a relatively low supply of energy at each of the emitted MSEs. This may be desirable, for example, when a more uniform energy distribution profile is desired across object 11.

For other applications, there may be a desire to have the at least one processor implement a function that causes a relatively high supply of energy. This may be desirable to target specific areas of an object with higher absorbable energy profiles. For yet other applications, it may be desirable to customize the amount of energy supplied to a known, estimated or suspected energy absorption profile of the object 11. In still other applications, a dynamic algorithm or a look-up table can be applied to vary the energy applied as a function of at least absorbable energy and perhaps one or more other variables or characteristics. These are but a few examples of how energy transmitted (or supplied) into the zone at each of the subset of MSEs may be a function of the absorbable energy value at each MSE. The invention is not limited to any particular scheme, but rather may encompass any suitable technique for controlling the energy supplied by taking into account an indicator of absorbable energy.

In certain embodiments, the at least one processor may be configured to cause energy to be supplied to the at least one radiating element in at least a subset of the plurality of MSEs, wherein energy transmitted to the zone at each of the subset of MSEs is inversely related to the absorbable energy value at each MSE. Such an inverse relationship may involve a general trend, such as when an indicator of absorbable energy in a particular MSE subset (i.e., one or more MSEs) tends to be relatively high, the actual incident energy at that MSE subset may be relatively low. And when an indicator of absorbable energy in a particular MSE subset tends to be relatively low, the incident energy may be relatively high. The inverse relationship may be even more closely correlated. For example, in the presently disclosed embodiments, the transmitted energy may be set such that its product with the absorbable energy value (i.e., the absorbable energy by object 11) is substantially constant across the MSEs applied.

In certain embodiments, the at least one processor may be configured to adjust energy supplied such that when the energy supplied is plotted against an absorbable energy value over a range of MSEs, the two plots tend to mirror each other. In the presently disclosed embodiments, the two plots may be mirror images of each other. The plots may not exactly mirror each other, but rather, have generally opposite slope directions. For example, when the value corresponding to a particular MSE in one plot is relatively high, the value corresponding to the particular MSE in the other plot may be relatively low.

Some exemplary schemes can lead to more spatially uniform energy absorption in the object 11, for example when making yogurt, reacting chemical solution of making beer. As used herein, "spatial uniformity" refers to a condition where the energy absorption (i.e., dissipated energy) across the object or a portion (e.g., a selected portion) of the object that is targeted for energy application is substantially constant (for example, constant per volume unit or per mass unit). The energy absorption is considered "substantially constant" if the variation of the dissipated energy at different locations of the object is lower than a threshold value. For instance, a deviation may be calculated based on the distribution of the dissipated energy, and the absorbable energy is considered "substantially constant" if the deviation is less than 50%. Because, in many cases, spatially uniform energy absorption may result in spatially uniform temperature increases, consistent with the presently disclosed embodiments, "spatial uniformity" may also refer to a condition where the temperature increase across the object or a portion of the object that is targeted for energy application is substantially constant. The temperature increase may be measured by a sensing device, such as a temperature sensor in zone 9.

In order to achieve substantially constant energy absorption in an object or a portion of an object, controller 101 may be configured to hold substantially constant the amount of time at which energy is supplied to radiating elements 102 at each frequency, while varying the amount of power supplied at each frequency as a function of the absorbable energy value.

In certain situations, when the absorbable energy value is below a predetermined threshold for a particular MSE or MSEs, it may not be possible to achieve uniformity of absorption at each MSE. In such instances, consistent with the presently disclosed embodiments, controller 101 may be configured to cause the energy to be supplied to the antenna for that particular MSE or MSEs at a power level substantially equal to a maximum power level of the device. Alternatively, consistent with some other embodiments, controller 101 may be configured to cause the amplifier to supply low energy or no energy at all at these particular MSE or MSEs. At times, controller 101 may be configured to supply energy at a power level substantially equal to a maximum power level of the amplifier only if the amplifier may supply to the object 11*a* percentage of energy as compared with the uniform transmitted energy level (e.g. 50% or more or, in some cases, 80% or more). At times, controller 101 may supply energy at a power level substantially equal to a maximum power level of the amplifier only if the reflected energy is below a predetermined threshold, in order, for example, to prevent the apparatus from absorbing excessive power. For example, the decision may be made based on the temperature of a "dummy load," or load other than the object 11, into which reflected energy is introduced, or a temperature difference between the dummy load and the environment. The at least one processor may accordingly be configured to control the reflected energy or the absorbed energy by a dummy load. Similarly, if the absorbable energy value exceeds a predetermined threshold, the controller 101 may be configured to cause the antenna to supply energy at a power level less than a maximum power level of the antenna.

In an alternative scheme, uniform absorption may be achieved by varying the duration of energy delivery while maintaining the power applied at a substantially constant level. In other words, for example, for MSEs exhibiting lower absorbable energy values, the duration of energy application may be longer than for MSEs exhibiting higher absorption values. In this manner, an amount of power supplied at multiple MSEs may be kept substantially constant, while an amount of time at which energy is supplied varies, depending on an absorbable energy value at the particular MSE. Other configurations in which the amount of power supplied at multiple MSEs is not constant are also contemplated.

Because absorbable energy can change based on a host of factors including object temperature, depending on application, it may be beneficial to regularly update absorbable energy values and thereafter adjust energy application based on the updated absorption values. These updates can occur multiple times a second, or can occur every few seconds or longer, depending on application. As a general principle, more frequent updates may increase the uniformity of energy absorption.

In accordance with another aspect of the invention, the at least one processor may be configured to determine a desired energy absorption level at each of a plurality of MSEs and adjust energy supplied from the antenna at each MSE in order to target the desired energy absorption level at each MSE. For example, as discussed earlier, the controller 101 may be configured to target a desired energy absorption level at each MSE in attempt to achieve or approximate substantially uniform energy absorption across a range of frequencies. Alternatively, the controller 101 may be configured to target an energy absorption profile across the object 11. Such a targeted energy absorption profile may, for example, be, calculated to avoid uniform energy absorption, or to achieve substantially uniform absorption in a portion of the object 11.

In some embodiments, the at least one processor may be configured to adjust energy supplied from the antenna at each MSE in order to obtain a desired target energy effect and/or energy effect in the object, for example: a different amount of energy may be provided to different parts and/or regions of the object.

Reference is now made to FIG. 8A, which provides a diagrammatic representation of an exemplary apparatus 800 for applying electromagnetic energy to an object placed in a container, in accordance with some embodiments of the present invention. In accordance with some embodiments, apparatus 800 may include a processor 2030 which may regulate modulations performed by modulator 2014. In some embodiments, modulator 2014 may include at least one of a phase modulator, a frequency modulator, and an amplitude modulator configured to modify the phase, frequency, and amplitude of an AC waveform generated by power supply 2012. Processor 2030 may alternatively or additionally regulate at least one of location, orientation, and configuration of each radiating element 2018, for example, using an electromechanical device. Radiating element(s) 2018 may be located inside a container in accordance to the embodiments of the invention. Such an electromechanical device may include a motor or other movable structure for rotating, pivoting, shifting, sliding or otherwise changing the orientation and/or location of one or more of radiating elements 2018. Alternatively or additionally, processor 2030 may be configured to regulate one or more field adjusting elements located in the energy application zone, in order to change the field pattern in the zone. Field adjusting elements may be any elements placed in the energy application zone (e.g. an inner housing) configured to adjust a field pattern excited in the energy application zone. Field adjusting elements may be electrically connected or electrically shorted to the outer and/or inner housing.

In some embodiments, apparatus 800 may involve the use of at least one source (also referred to as power source) configured to transmit electromagnetic energy to the energy application zone. By way of example, and as illustrated in FIG. 8A, the source may include one or more of a power supply 2012 configured to generate electromagnetic waves that carry electromagnetic energy. For example, power supply 2012 may include a magnetron configured to generate high power microwave waves at a predetermined wavelength or frequency. Alternatively, power supply 2012 may include a semiconductor oscillator, such as a voltage controlled oscillator, configured to generate AC waveforms (e.g., AC voltage or current) with a constant or varying frequency. AC waveforms may include sinusoidal waves, square waves, pulsed waves, triangular waves, or another type of waveforms with alternating polarities. Alternatively, a source of electromagnetic energy may include any other power supply, such as electromagnetic field generator, electromagnetic flux generator, or any mechanism for generating vibrating electrons.

In some embodiments, apparatus 800 may include a phase modulator (not illustrated) that may be controlled to perform a predetermined sequence of time delays on an AC waveform, such that the phase of the AC waveform is increased by a number of degrees (e.g., 10 degrees) for each of a series of time periods. In some embodiments, processor 2030 may dynamically and/or adaptively regulate modulation based on feedback from the energy application zone. For example, processor 2030 may be configured to receive an analog or digital feedback signal from detector 2040, indicating an amount of electromagnetic energy received from the energy application zone (e.g. inner volumes 214 and 234), and processor 2030 may dynamically determine a time delay at the phase modulator for the next time period based on the received feedback signal. Detector 2040 may comprise a coupler (e.g. dual directional coupler) configured to receive and detect both transmitted and received RF energy or power In some embodiments, apparatus 100 may include a frequency modulator (not illustrated). The frequency modulator may include a semiconductor oscillator configured to generate an AC waveform oscillating at a predetermined frequency. The predetermined frequency may be in association with an input voltage, current, and/or other signal (e.g., analog or digital signals). For example, a voltage controlled oscillator may be configured to generate waveforms at frequencies proportional to the input voltage.

Processor 2030 may be configured to regulate an oscillator (not illustrated) to sequentially generate AC waveforms oscillating at various frequencies within one or more predetermined frequency bands. In some embodiments, a predetermined frequency band may include a working frequency band, and the processor may be configured to cause the transmission of energy at frequencies within a sub-portion of the working frequency band. A working frequency band may include a collection of frequencies selected because, in the aggregate, they achieve a desired goal, and there is diminished need to use other frequencies in the band if that sub-portion achieves the goal. Once a working frequency band (or subset or sub-portion thereof) is identified, the processor may sequentially apply power at each frequency in the working frequency band (or subset or sub-portion thereof). This sequential process may be referred to as "frequency sweeping." In some embodiments, each frequency may be associated with a energy delivery scheme (e.g., a particular selection of MSEs). In some embodiments, based on the feedback signal provided by detector 2040, processor 2030 may be configured to select one or more frequencies from a frequency band, and regulate an oscillator to sequentially generate AC waveforms at these selected frequencies.

Alternatively or additionally, processor 2030 may be further configured to regulate amplifier 2016 to adjust amounts of energy transmitted via radiating elements 2018, based on the feedback signal. Consistent with some embodiments, detector 2040 may detect an amount of energy reflected from the energy application zone and/or energy coupled at a particular frequency, and processor 2030 may be configured to cause the amount of energy transmitted at that frequency to be low when the reflected energy and/or coupled energy is low. Additionally or alternatively, processor 2030 may be configured to cause one or more antennas to transmit energy at a particular frequency over a short duration when the reflected energy is low at that frequency.

In some embodiments, the apparatus may include more than one source of EM energy. For example, more than one oscillator may be used for generating AC waveforms of differing frequencies. The separately generated AC waveforms may be amplified by one or more amplifiers. Accordingly, at any given time, radiating elements 2018 may be caused to simultaneously transmit electromagnetic waves at, for example, two differing frequencies to inner housing 214 or 234.

Processor 2030 may be configured to regulate the phase modulator in order to alter a phase difference between two electromagnetic waves supplied to the energy application zone. In some embodiments, the source of electromagnetic energy may be configured to supply electromagnetic energy in a plurality of phases, and the processor may be configured to cause the transmission of energy at a subset of the plurality of phases. By way of example, the phase modulator may include a phase shifter. The phase shifter may be configured to cause a time delay in the AC waveform in a controllable manner within inner housing 214 or 234, delaying the phase of an AC waveform anywhere from between 0-360 degrees.

In some embodiments, a splitter (not illustrated) may be provided in apparatus 800 to split an AC signal, for example generated by an oscillator, into two AC signals (e.g., split signals). Processor 2030 may be configured to regulate the phase shifter to sequentially cause various time delays such that the phase difference between two split signals may vary over time. This sequential process may be referred to as "phase sweeping." Similar to the frequency sweeping described above, phase sweeping may involve a working subset of phases selected to achieve a desired energy application goal.

The processor may be configured to regulate an amplitude modulator in order to alter an amplitude of at least one electromagnetic wave supplied to the energy application zone. In some embodiments, the source of electromagnetic energy may be configured to supply electromagnetic energy in a plurality of amplitudes, and the processor may be configured to cause the transmission of energy at a subset of the plurality of amplitudes. In some embodiments, the apparatus may be configured to supply electromagnetic energy through a plurality of radiating elements, and the processor may be configured to supply energy with differing amplitudes simultaneously to at least two radiating elements.

Although FIGS. 2A, 2B, 5B and 8A illustrate circuits including two radiating elements (e.g., antennas 206, 208; 226, 526, 528; or 2018), it should be noted that any number of radiating elements may be employed, and the circuit may select combinations of MSEs through selective use of radiating elements. By way of example only, in an apparatus having three radiating elements A, B, and C, for example containers 300 and 500, amplitude modulation may be performed with radiating elements A and B, phase modulation may be performed with radiating elements B and C, and frequency modulation may be performed with radiating elements A and C. In some embodiments amplitude may be held constant and field changes may be caused by switching between radiating elements and/or subsets of radiating elements. Further, radiating elements may include a device that causes their location or orientation to change, thereby causing field pattern changes. The combinations are virtually limitless, and the invention is not limited to any particular combination, but rather reflects the notion that field patterns may be altered by altering one or more MSEs.

Some or all of the forgoing functions and control schemes, as well as additional functions and control schemes, may be carried out, by way of example, using structures such as the electromagnetic energy application subsystems schematically depicted in FIG. 1 or FIG. 8A.

Figure 8B:
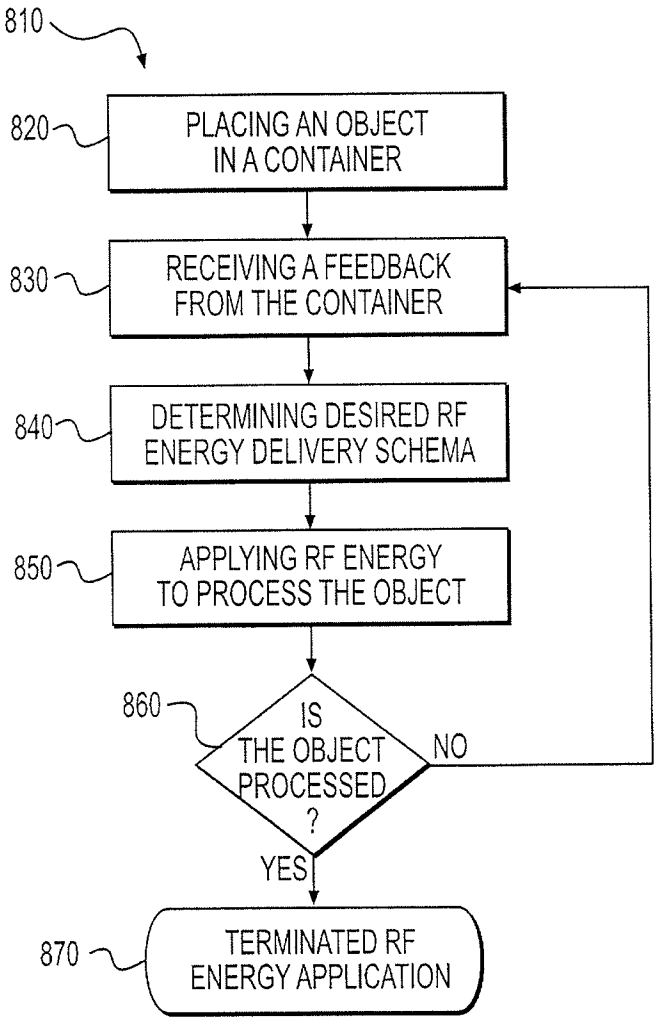
FIG. 8B is a flowchart presenting a method for applying RF energy to a container, in accordance with some embodiments of the invention.

In certain embodiments, a method may involve controlling a source of electromagnetic energy. As previously discussed, a "source" of electromagnetic energy may include any components that are suitable for generating electromagnetic energy, for example in the RF range. By way of example only, at least one processor (e.g., processor 2030 or controller 101) may be configured to control electromagnetic energy application. A flowchart of method 810, for applying RF energy to process an object placed in a container, in accordance with some embodiments of the invention, is illustrated in FIG. 8B. An object to be processed may be placed in a container, in step 820. The object may be placed in the inner volume of the inner housing of the container (e.g., inner volumes 214 or 234). The object may include a liquid phase (e.g., a yogurt, a chemical solution, a beer, etc), a solid state (e.g., a steak, a chicken, dense green bodies to be sintered, etc.), a gas phase or a combination of more than one state (e.g., liquid soup containing solid ingredients, uncooked eggs, broccoli to be steamed, etc.). In step 830, a feedback may be received from the container, for example from detectors 2040. The feedback may indicate a physical property of the object, for example: a temperature, pH level, density, pressure, volume, humidity, density etc. In some embodiments, the feedback may include values directly determined (e.g., detected) for one or more parameters associated with operation of RF processing apparatus 100 or 800 (e.g., power level, an amount of energy received, S-parameters etc.). Those values and other similar values may constitute EM feedback. EM feedback may also include quantities that may be determined indirectly (e.g., calculated) based on one or more directly determined values. For example, EM feedback may include calculated quantities, such as dissipation ratios (DR), average DR or other quantities, derivatives of DR or any other feedback quantity, etc. Optionally, the feedback may indicate a value indicative of energy absorbable in the object, for example DR, or any one of the scattering parameters (e.g., S11, S22, S12, etc.) Additionally or alternatively, EM feedback(s) may include all possible EM feedback signals (e.g., power levels) detected in or around the energy application zone (for example, EM feedback detected or measured on the radiating element) and/or any parameter calculated based on the detected EM feedback signals. The EM feedback may include any calculations (e.g., mathematical calculations) performed on the EM feedback, for example, an average value of the EM feedback over a set of parameters, for example over a set of MSEs. The EM feedback may be indicative of one or more of the reflected, transmitted, coupled (e.g., to other radiating elements) and incident energies. The processor (e.g., processor 2030 or controller 101) may be configured to receive and/or interpret EM feedback when a particular MSE application scheme may be excited in the energy application zone. For example, the processor may be configured to obtain EM feedback as a function of applied MSEs. The processor may be configured to receive EM feedback at each of a plurality of MSEs. Additionally or alternatively, the processor may control RF energy application to test the object (placed in an energy application zone) for determining the received feedback. One exemplary way to conduct such a test is through a sweep, as discussed earlier. Step 830 may repeat several times during the RF energy application and/or in between two consecutive RF energy applications.

In some embodiments, a desired RF energy delivery scheme may be determined in step 840. An energy delivery scheme may include all optional parameters that may be adjusted before or during the RF energy application, for example: power level, time duration, frequency, energy, phase or any other parameter in the MS space. The processor may be configured to determine an energy delivery scheme by choosing at least one MSE from a plurality of MSEs at which energy is to be applied to the energy application zone (e.g., the inner volume). In some embodiments, the processor may choose the MSE based on a feedback (e.g., DR, temperature, etc.) received from the container.

In certain embodiments, the method may also involve determining an amount of incident electromagnetic energy for at least one MSE based on the absorbable energy value at the MSE. For example, in step 840, at least one processor may determine an amount of energy to be transmitted (applied) at an MSE, as a function of the absorbable energy value associated with that MSE.

In some embodiments, determining energy delivery scheme may include a choice not to use all possible MSEs in a working band. For example, a choice may be made to limit MSEs to a sub band of MSEs where the Q factor in that sub band is smaller or higher than a threshold. Such a sub band may be, for example 50 MHz wide or more or even 100 MHz wide or more, 150 MHz wide or more, or even 200 MHz wide or more.

In some embodiments, the at least one processor may determine the power level used for supplying a determined amount of energy at each MSE, as a function of the absorbable energy value. When making the determination of the power level, energy may be supplied for a constant amount of time at each MSE. Alternatively, the at least one processor may determine varying durations at which the energy is supplied at each MSE, assuming a substantially constant power level. In the presently disclosed embodiments, the at least one processor may determine both the power level and time duration for supplying the energy at each MSE.

In some embodiments, controller 101 or processor 2030 may be configured to hold substantially constant the amount of time at which energy is supplied at each MSE, while varying the power level at each MSE. In other embodiments, controller 101 or processor 2030 may be configured to cause the energy to be supplied to the radiating element at a power level substantially equal to a maximum power level, while supplying the energy over varying time durations at each MSE. In the presently disclosed embodiments, both the power and duration of energy delivery at different MSEs may be varied.

RF energy may be applied, in step 850, to the energy application zone according to the desired RF energy delivery scheme determined in step 840. Energy may be supplied from the power supply in order to activate at least one radiating element. The radiating element(s) may transmit RF energy to the energy application zone, by, for example, exciting a desired EM field pattern in the zone using a particular MSE, or exciting a plurality of field patterns using a plurality of MSEs.

Energy application may be interrupted periodically (e.g., several times a second) for a short time (e.g., only a few milliseconds or tens of milliseconds). Once energy application is interrupted, in step 860, it may be determined if the energy transfer should be terminated. Energy application termination criteria may vary depending on application. For example, for a heating application, termination criteria may be based on time, temperature, total energy absorbed, or any other indicator that the process at issue is compete. For example, heating may be terminated when the temperature of object 11 rises to a predetermined temperature threshold. In another example, in thawing application, termination criteria may be any indication that the entire object is thawed. In some embodiments. RF energy application may be terminated by a user, e.g., by switching OFF the container.

If in step 860, it is determined that energy transfer should be terminated (step 860: yes), energy transfer may end in step 870. If the criterion or criteria for termination is not met (step 860: no), the process may return to step 830 to continue transmission of electromagnetic energy. For example, after a time has lapsed, the object properties may have changed; which may or may not be related to the electromagnetic energy transmission. Such changes may include temperature change, translation change in shape (e.g., mixing, thawing or deformation for any reason) or volume change (e.g., shrinkage or puffing) or water content change (e.g., drying), flow rate, change in phase of matter, chemical modification, etc. Therefore, at times and in response, it may be desirable to change the energy delivery scheme. The new scheme that may be determined may include: a new set of MSEs, an amount of electromagnetic energy incident or delivered at each of the plurality of MSEs, weight, e.g., power level, of the MSE(s) and duration at which the energy is supplied at each MSE. Consistent with some of the presently disclosed embodiments, less MSEs may be swept before the energy application phase, such that the energy application process is interrupted for a minimum amount of time.

Figure 9A:
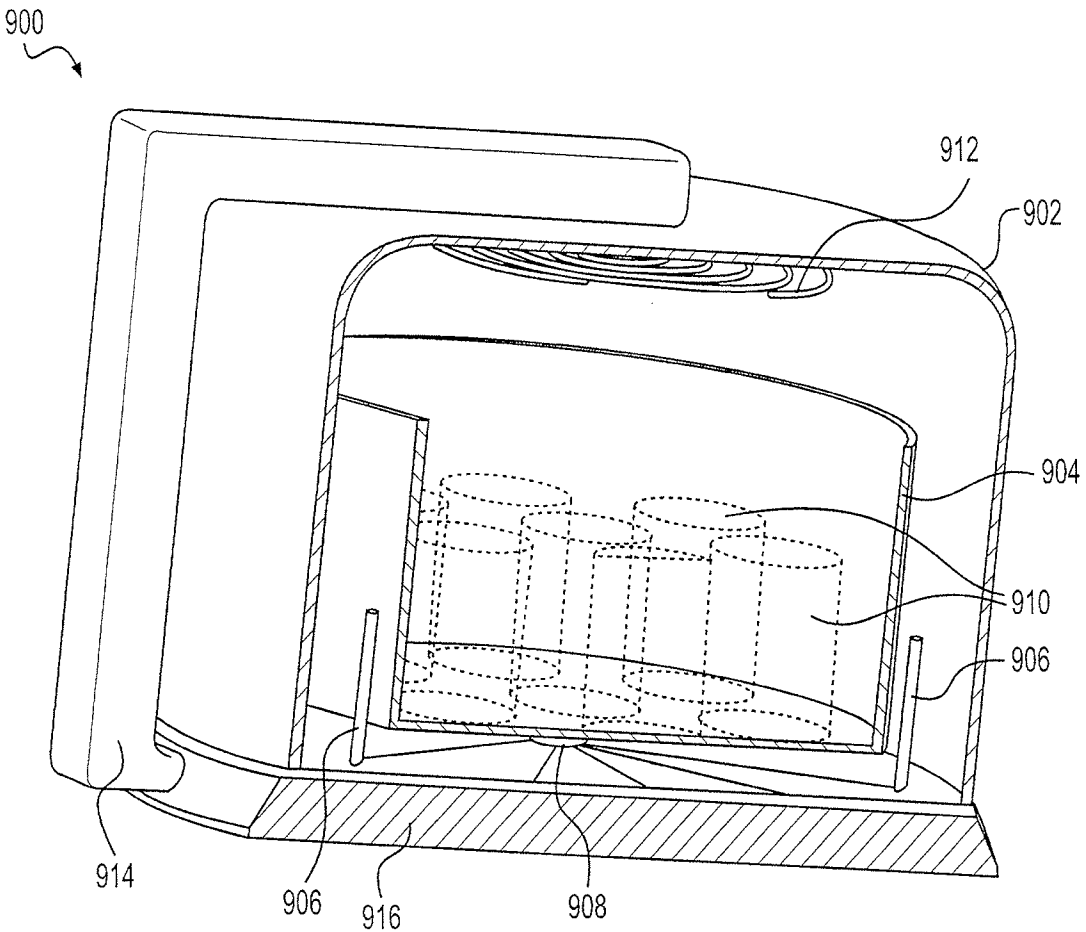
FIGS. 9A-9C include diagrammatic representations of an RF cooking utensil, in accordance with some embodiments of the invention.
Figure 9B:
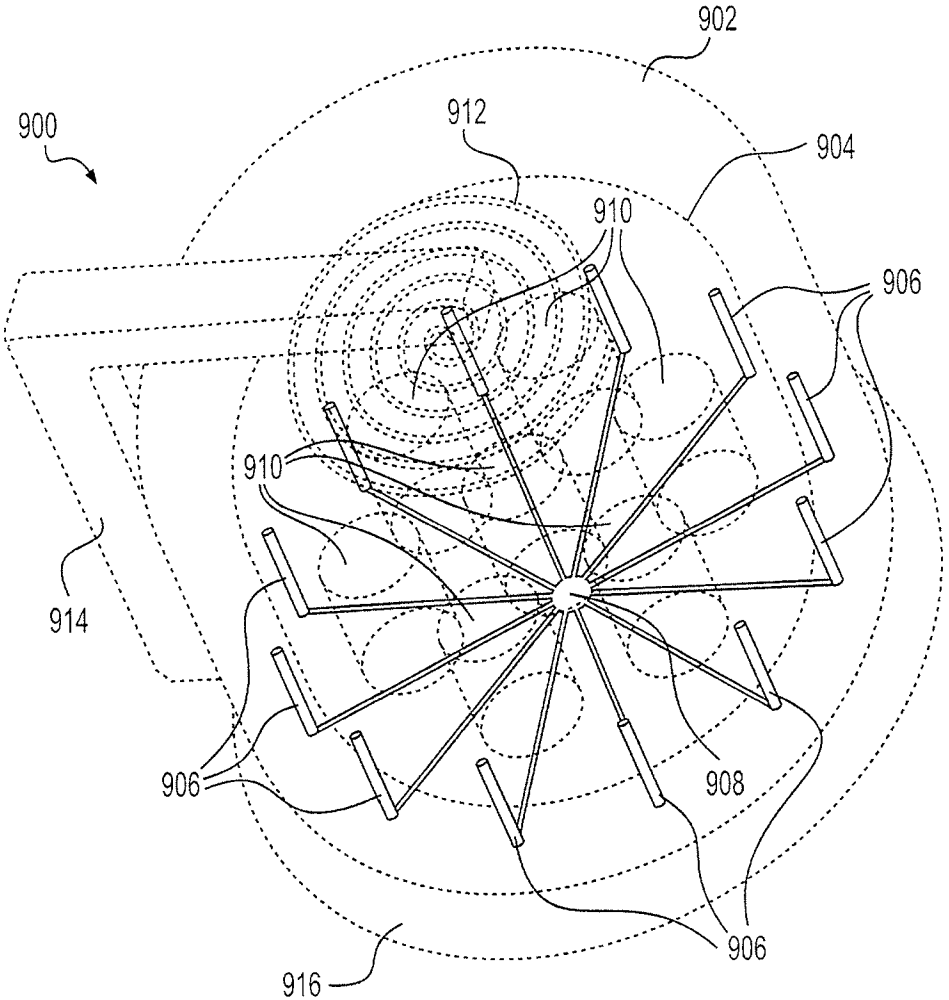
Figure 9C:
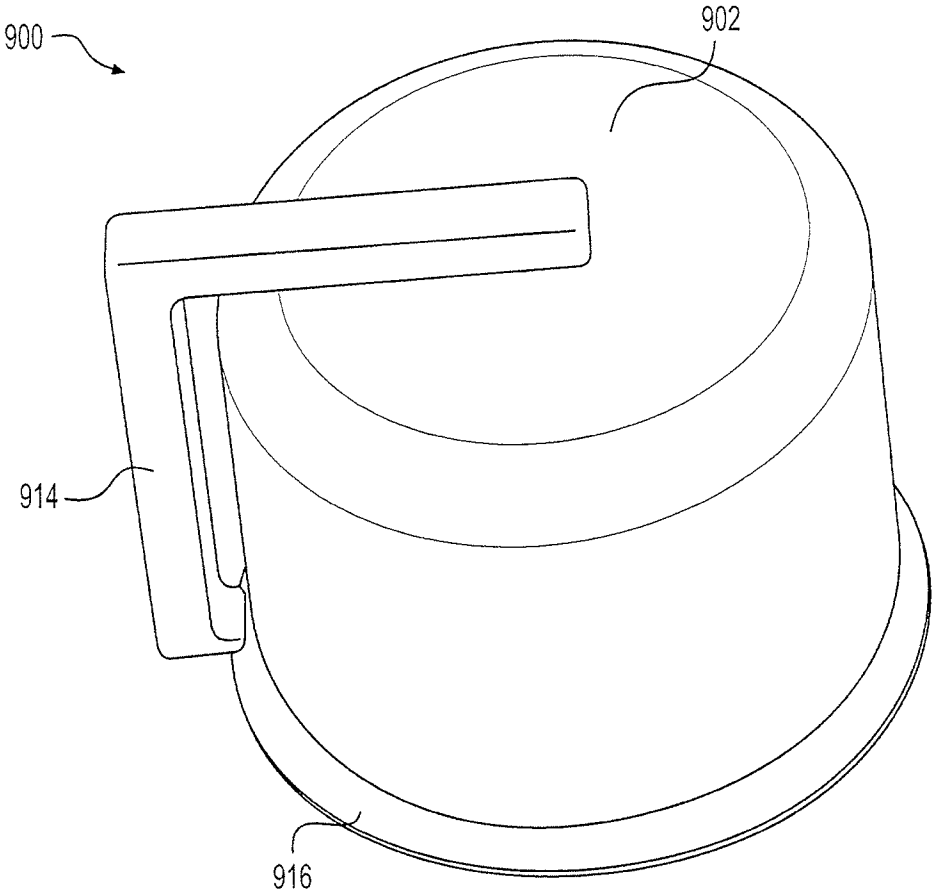

An exemplary RF cooking utensil in accordance with some embodiments of the invention is illustrated in FIGS. 9A-9C. Cooking utensil 900 is an exemplary cooking container, in accordance with some embodiments of the invention. FIG. 9A provides a cut away perspective view of cooking utensil 900, FIG. 9B is a semi transparent perspective view of cooking utensil 900, and FIG. 9C is a perspective view of cooking utensil 900. Cooking utensil 900 may include outer housing 902. Outer housing 902 may be constructed from conductive materials commonly used in cooking utensils, for example, stainless steel (e.g., SAE 304L or SAE 316L). Utensil 900 may include inner housing 904. Inner housing 904, may have a shape of a pot, a dish or bowl, and may be constructed from RF transparent materials, such as those commonly used in cooking utensils (e.g., tempered soda-lime glass (also known as PYREX)). Cooking utensil 900 may further include a plurality of antennas 906, e.g., 6, 8, 10, 12 or 14 antennas (not all are illustrated), arranged in a similar manner to the radiating elements illustrated in FIG. 4. All antennas may be connected to a single feed 908 that feeds RF radiation to each antenna.

In some embodiments, cooking utensil 900 may further include IR (Infra Red) heating elements 912 configured, for example, to brown the food placed in inner housing 904.

In some embodiments, one or more surfaces of inner housing 904 and/or outer housing 902 803 may include a transparent or semi transparent portion so as to allow a user to view a processed object during, for example, a cooking process. The transparent portion may be made of any transparent material having a high RF blocking and/or reflecting coefficient. Optionally, a perforated conductive sheet may be attached and/or embedded within a transparent material, e.g. a glass.

Outer housing 902 and inner housing 904 may be mounted on base 916. Base 916 may be an exemplary cover in accordance with some embodiments of the invention. Lock 914 may be configured to close outer housing 902 and base 916 such that no leakage or substantially no leakage of RF radiation may occur. For example, lock 914 may apply pressure between outer housing 902 and base 916 to obtain electrical contact between the surface of base 916 and the lower end of outer housing 902. FIG. 9C illustrates cooking utensil 900 when closed by lock 914.

An object may be placed in inner housing 904. For example, a soup or a stew may be cooked in utensil 900, filling most of the inner volume in inner housing 904. Alternatively, several distinctive food items (e.g., 2-10 food items, for example, as illustrated, seven food items) may be cooked together in utensil 900, for example food items 910 illustrated in FIGS. 9A-9B. The seven food items may be substantially identical (e.g., seven eggs, or seven beef steaks) or may be different (i.e. at least two of the items may be different).

Figure 10:
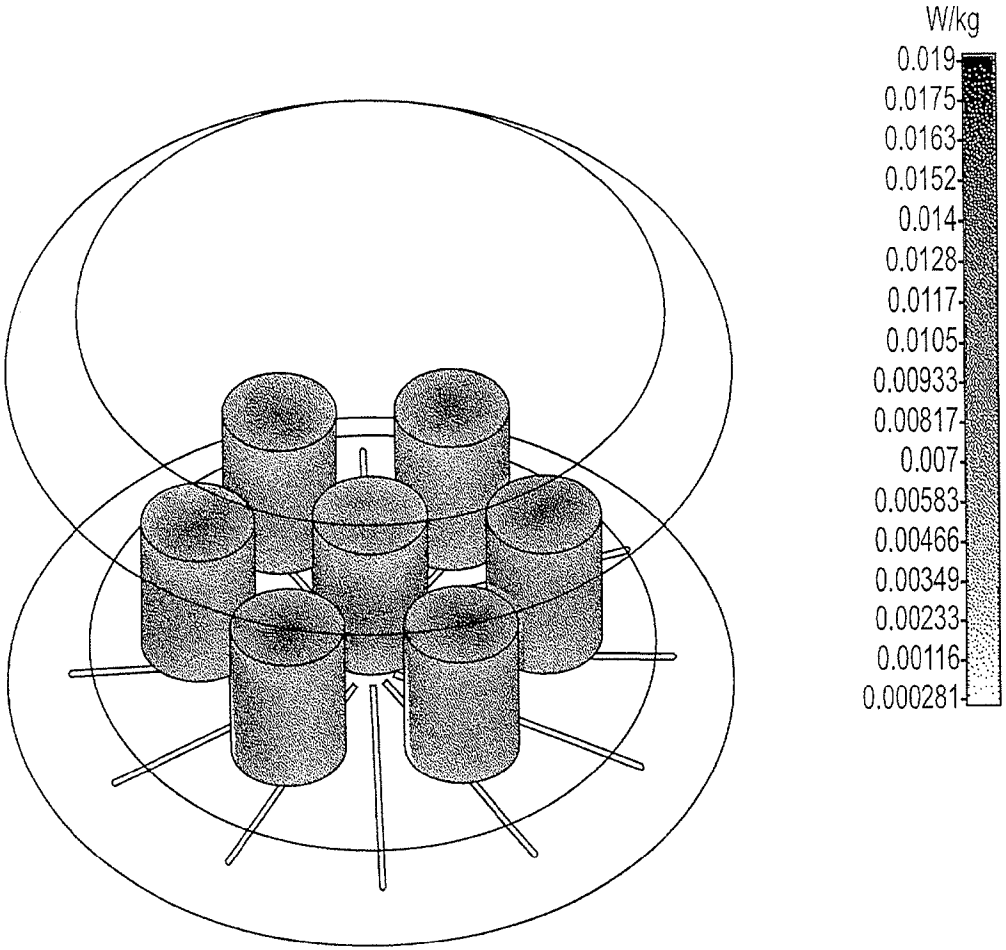
FIG. 10 is a field intensity map representing a simulation of 7 200 ml water cups placed in an RF cooking utensil, in accordance with some embodiments of the invention.

Simulation results (maps) of RF energy application (average SAR) to cooking utensil 900 are presented in FIG. 10. Seven cylindrical samples of 200 ml of water (e.g., items 910) were simulated in utensil 900. The simulation included an RF radiation application to the utensil at a plurality of frequencies vary from 800-1000 MHz. A logarithmic intensity bar (in W/Kg units) is presented in the right side of the simulation map, wherein the high intensities are marked with dark gray and the low intensities in very light gray. The simulation showed substantially uniform energy absorption in the water cylinders, mostly in the intermediate energy absorption range (mid grays) with a slight rise in the central part of the cylinders.

Figure 11A:
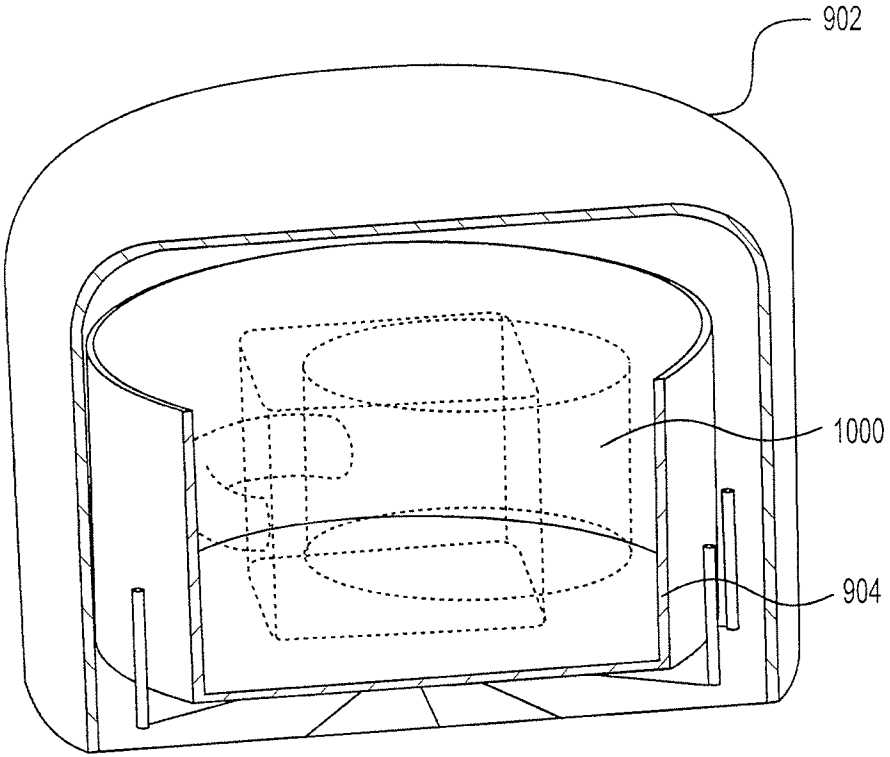
FIG. 11A is an illustration of an object having an irregular shape place in an RF cooking utensil, in accordance with some embodiments of the invention.
Figure 11B:
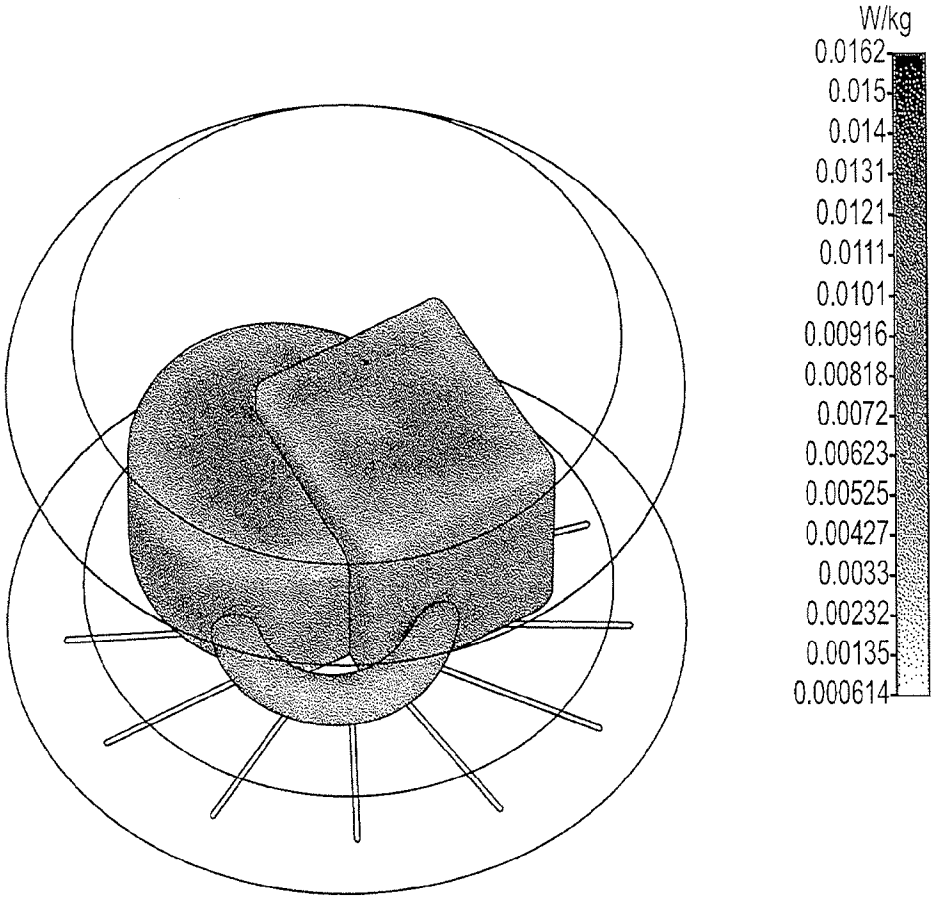
FIG. 11B is a field intensity map representing a simulation of the irregular shaped object of FIG. 11A, in accordance with some embodiments of the invention.

FIG. 11A is a cut away perspective view of cooking utensil 900, when an irregular shaped large object 1000 is placed in the utensil 900. The irregular shaped object was used in a simulation to simulate a real food object such as whole chicken, a large portion of beef (for example for roast beef), a bread etc. Simulation results (average SAR) of RF energy application to object 1000 placed in utensil 900 are presented in FIG. 11B. A logarithmic intensity bar (in W/Kg units), similar to the one presented in FIG. 10, is presented in the right side of the simulation map. As shown in the FIG. 11B simulation, most of object 1000 absorbs RF energy uniformly with a slight increase in the central, middle part of the object.

Figure 12:
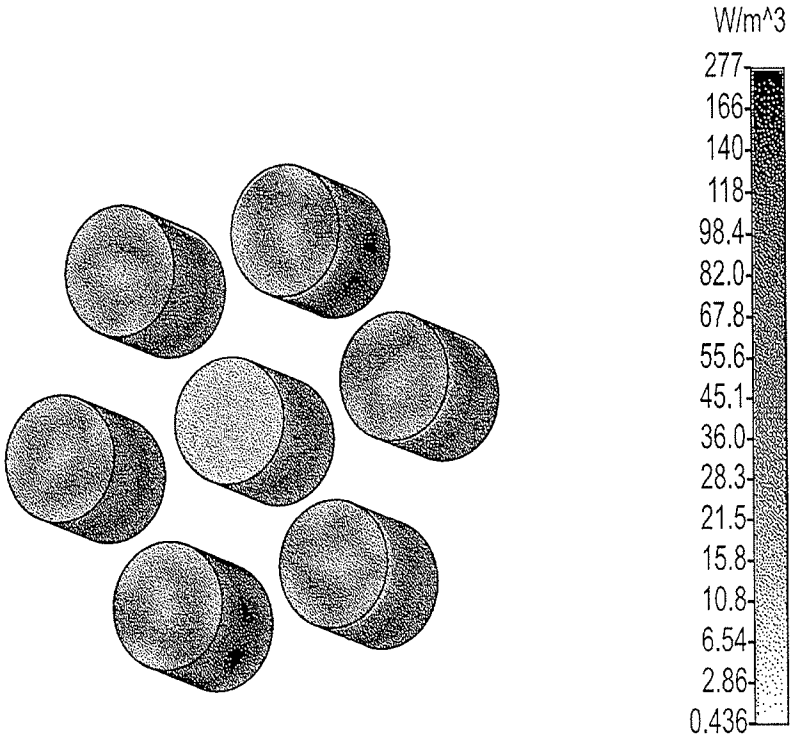
FIG. 12 is a field intensity map representing a simulation of RF energy excited in an RF cooking utensil using various MSEs, in accordance with some embodiments of the invention.

FIG. 12 presents another RF energy application simulation done in the same conditions (the same utensil and the same object) as the simulation results presented in FIG. 10. RF energy was simulated to be applied using a standard ISM band 902-928 MHz power supply. The results show slightly less homogeneous field intensity distribution, in comparison to the results presented in FIG. 10 with high intensities in the middle part of the water cylinders. The difference may result from the use of a wider frequency band than the 800-1000 MHz band used in the simulation associated with FIG. 10.

Although the simulations and models presented in FIGS. 9-12 refer to a cooking utensil and food items, the invention is not limited to cooking utensils and may be implemented successfully with any container configured to utilize RF energy for processing an object placed in the container.

EXAMPLE

Chicken Soup

In the following paragraphs, examples of several possible applications of the principles of the present disclosure are given, in the context of a device (e.g., container) and a method for cooking soup and/or extraction.

Making soup in the conventional manner is time consuming. For example, making soup may take at least an hour or even more, depending on the recipe. Making soup faster and at high energy efficiency may save time, money, and energy, especially in an industrial or commercial setting. During cooking, the soup can be heated to allow the extraction of soluble and miscible components of the soup's ingredients (e.g. chicken, vegetables etc.) into the liquid and also to concentrate the broth.

When cooking soup conventionally, the pot and the water are usually heated first and then the soup solid ingredients (e.g. chicken, vegetables etc.) are heated subsequently. If it were in the opposite manner, so that the solid soup ingredients would be hotter than the liquid, soluble and miscible components might flow out and/or extract into the solution faster.

When heating uniformly using EM energy, e.g. RF energy, as described above, it may be possible to have differential temperatures due to differences between heat capacities of the water in comparison to those of the chicken and the vegetables, and/or due to differences in their dissipation rates. Data available at http://www.engineeringtoolbox.com/specific-heat-capacity-food-d_295.html show that the heat capacity of chicken hens is 2.72 kJ/(kg deg C.), and the heat capacity of carrot is 3.81 kJ/(kg deg C.). Both heat capacities are considerably lower than the heat capacity of water: 4.2 kJ/(kg deg C.).

In an exemplary comparative application of the present container, applicants cooked the same chicken soup recipe on a conventional professional-kitchen electric stove (3 kW) and in a 900 Watt RF oven or container (i.e. an oven/container that applies RF energy for object processing, for example an oven/container comprising apparatus 100 or 800 described above). The RF oven was operated to achieve uniform heating. The RF oven had 2 antennas and no other form of heating was used in addition to the RF heating. The soups were done to taste after 1 hour (stove) and after 20 minutes (RF oven), respectively.

In some embodiments, a method or a device for cooking a chicken soup by applying EM energy, e.g. RF energy, may include faster preparation and/or decreased energy use. Additionally or alternatively, in an RF heating process, the heated water may be kept below the boiling point, which might keep the natural nutrients (e.g. vitamins) of the chicken and vegetables more viable.

Figure 13:
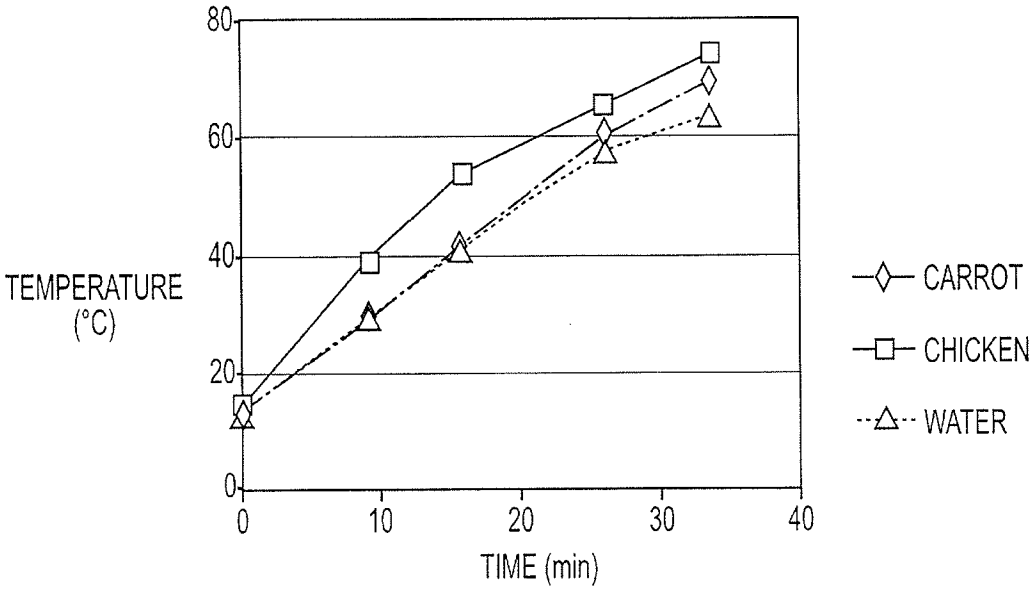
FIG. 13 is a graph showing the evolution of temperature over time in water, chicken, and carrot, heated simultaneously in an oven according to exemplary embodiments of the present invention.

It is suggested that this result occurs because solid portions of the soup are heated faster than the water. The following experiment seems to confirm this hypothesis. A whole carrot (65 g) and ½ a chicken (750 g) were placed in 2,385 g of tap water. The mixture was heated in an RF oven at full power using a sweep of a plurality of RF frequencies between 800 MHz and 1000 MHz. Temperature was measured using a conventional kitchen thermometer before, during and after cooking. FIG. 13 is a graph depicting the temperatures measured. As can be seen, the temperature of the chicken was consistently higher than that of the water. To a lesser extent, the same was true for the carrot. Additionally, after cooking, the weight of each component was also measured (carrot: 60 g; chicken: 635 g; water 2415 g). While the carrot lost 5 g (7.7% out of 65 g), the chicken lost 115 g (15.3% out of 750 g), showing the higher extraction rate from the chicken. The total weight loss, presumably due primarily to evaporation was 90 g.

In the foregoing Description of Exemplary Embodiments, various features are grouped together in a single embodiment for purposes of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate embodiment of the invention.

Moreover, it will be apparent to those skilled in the art from consideration of the specification and practice of the present disclosure that various modifications and variations can be made to the disclosed systems and methods without departing from the scope of the invention, as claimed. For example, one or more steps of a method and/or one or more components of an apparatus or a device may be omitted, changed, or substituted without departing from the scope of the invention. Thus, it is intended that the specification and examples be considered as exemplary only, with a true scope of the present disclosure being indicated by the following claims and their equivalents.

What is claimed is:

1. A container for processing an object contained in the container by applying radiofrequency (RF) energy, the container comprising:

an outer housing;

an inner housing disposed at least partially within the outer housing, wherein at least a portion of the inner housing is transparent to RF radiation;

at least one antenna configured to apply RF energy to an energy application zone within the inner housing;

a processor configured to control application of RF energy to the energy application zone, wherein the processor is configured to control the RF energy application by selecting a set of modulation space elements, and cause RF energy application at the modulation space elements of the selected set, and wherein the modulation space elements include at least one of frequency, phase, and relative amplitude.

2. The container according to claim 1, further comprising a cover configured to reduce or prevent RF energy leakage from the container.

3. The container according to claim 2, wherein a choke or a gasket are provided on the cover.

4. The container according to claim 1, wherein a choke or a gasket are provided on the outer housing.

5. The container according to claim 1, wherein the at least one antenna is located external to the inner housing.

6. The container according to claim 1, wherein the at least one antenna is located between the inner housing and the outer housing.

7. The container according to claim 1, wherein the outer housing is substantially opaque to RF energy.

8. The container according to claim 1, wherein the at least one antenna is configured to apply RF energy at a plurality of modulation space elements.

9. The container according to claim 1, further comprising a power supply configured to supply RF energy to the at least one antenna.

10. The container according to claim 9, wherein the power supply includes a solid-state amplifier.

11. A container for processing an object contained in the container by applying radiofrequency (RF) energy, the container comprising:

an outer housing;

an inner housing disposed at least partially within the outer housing, wherein at least a portion of the inner housing is transparent to RF radiation;

at least one antenna configured to apply RF energy to an energy application zone within the inner housing;

a processor configured to control application of RF energy to the energy application zone; and a choke or a gasket configured to reduce or prevent RF energy leakage from the container, wherein the processor is configured to control the RF energy application by selecting a set of modulation space elements, and cause RF energy application at the modulation space elements of the selected set.

12. The container according to claim 1, wherein the processor is further configured to control the RF energy application based on a feedback received from the energy application zone.

13. The container according to claim 12, wherein the feedback received from the energy application zone is received at a plurality of modulation space elements.

14. The container according to claim 13, wherein the processor is further configured to control an amount of energy applied to the energy application zone at each modulation space element, based on feedback received at each respective modulation space element.

15. The container according to claim 1, wherein the container is a cooking utensil.

16. The container according to claim 1, wherein the inner housing includes a wave-guide.

17. The container according to claim 1, further comprising a stirrer located within the inner housing and configured to stir the object when it is within the inner housing.

18. A container, capable of holding standing liquids, for processing an object by applying Radio Frequency (RF) energy, comprising:

an outer housing;

an inner housing disposed within the outer housing and adapted to contain the object, wherein the inner housing is spaced apart from the outer housing and includes at least a portion that is transparent to RF energy;

at least one antenna located within a space between the outer housing and the inner housing and configured to apply RF energy to a volume within the inner housing; and a processor configured to control application of RF energy to the object, wherein the processor is configured to control the RF energy application by selecting a set of modulation space elements, and cause RF energy application at the modulation space elements of the selected set and wherein the modulation space elements include at least one of frequency, phase, and relative amplitude.

19. The container according to claim 18, wherein the processor is configured to control application of RF energy such that 50% or more of the RF energy is delivered to the object.

20. The container according to claim 18, wherein the outer housing is substantially opaque to RF energy.

21. The container according to claim 18, wherein the processor is further configured to control the application of RF energy based on a feedback.

* * * * *